United States Patent [19]

Fedder et al.

[11] Patent Number: 4,975,084

[45] **Date of Patent: * Dec. 4, 1990**

[54] ELECTRICAL CONNECTOR SYSTEM

[75] Inventors: James L. Fedder, Etters; Matthew M. Sucheski, Harrisburg, both of Pa.

[73] Assignee: AMP Incorporated, Harrisburg, Pa.

[ * ] Notice: The portion of the term of this patent subsequent to Jul. 11, 2006 has been disclaimed.

[21] Appl. No.: 434,616

[22] Filed: Nov. 9, 1989

Related U.S. Application Data

[63] Continuation of Ser. No. 367,929, Jun. 19, 1989, abandoned, which is a continuation-in-part of Ser. No. 258,424, Oct. 17, 1988, abandoned, and a continuation-in-part of Ser. No. 289,633, Dec. 23, 1988, abandoned.

[51] Int. Cl.[5] ..... H01R 4/66; H01R 13/652

[52] U.S. Cl. ..... 439/608; 439/108

[58] Field of Search ..... 439/92, 108, 607, 608

[56] References Cited

U.S. PATENT DOCUMENTS

| | | | |
|---|---|---|---|
| 3,456,231 | 7/1969 | Paullus et al. | 439/532 |
| 3,864,000 | 2/1975 | Coller et al. | 439/79 |
| 4,558,917 | 12/1985 | Kamono et al. | 439/608 |
| 4,571,014 | 2/1986 | Robin et al. | 439/108 |
| 4,632,476 | 12/1986 | Schell | 439/95 |
| 4,705,332 | 11/1987 | Sadigh-Behzadi | 439/69 |
| 4,806,107 | 2/1989 | Arnold et al. | 439/79 |

OTHER PUBLICATIONS

"The demands of logic and power on backplanes", by Turner et al., Electronic Engineering, vol. 60, No. 736, Apr. 1988, pp. 53, 55, 56, 58, 60, 62.

*Primary Examiner*—Gary F. Paumen

*Attorney, Agent, or Firm*—Allan B. Osborne

[57] ABSTRACT

A high density, high frequency electrical connector system having ground contacts disposed between adjacent columns of signal carrying contacts to provide signal integrity. More particularly, the system includes two mating connectors with the ground contacts in one being blades and the ground contacts in the other being plates with blade engaging cantilever beams thereon so that when the two connectors are mated, the ground contacts complete a ground circuit and the plates provide a shield between adjacent columns of mated signal carrying contacts.

18 Claims, 27 Drawing Sheets

344
348
350
338
340
314
346
17
16
300
30
28
342
17
16
336
12
24
26
32
20
16
16b
16a
16c

ELECTRICAL CONNECTOR SYSTEM

This is a continuation-in-part of application Ser. No. 07/367,929 filed on Jun. 19, 1989, now abandoned, which was a continuation-in-part of application Ser. No. 07/258,424 filed on Oct. 17, 1988, now abandoned, and of application Ser. No. 07/289,633, filed on Dec. 23, 1988, now abandoned.

FIELD OF THE INVENTION

The invention disclosed herein relates to signal integrity in high density, high frequency connector systems of the type used to electrically interconnect high frequency signal circuits on backplanes, daughter cards and other like substrates.

BACKGROUND OF THE INVENTION

In the high speed technology of modern electronics, high frequency connectors have been developed for use with backplanes and printed circuit cards; e.g., daughter cards. Such connectors require shielding or ground planes between signal pins; e.g., a stripline configuration, to provide high frequency signal integrity and minimize interference from foreign sources. One such arrangement is disclosed in U.S. Pat. No. 4,632,476 wherein a terminal grounding unit comprises an insulating member having a row and column configuration of apertures for receiving pin terminals attached to and extending outwardly from a backplane on which the insulating member is mounted. Further, channels are provided in the insulating member between columns of apertures for receiving a shielding member which is terminated to U-shaped female contacts attached to the backplane and extending into the channels through slots in the channel floors. This arrangement provides a shield or ground plane between adjacent columns of pin terminals carrying high frequency signals.

U.S. Pat. No. 4,571,014 discloses a high frequency modular connector for use with a circuit board to interconnect the circuit board with a backplane. The connector comprises modules each having a pair of rectangular-shaped, circuit board members. The members are formed with several parallel fingers separated by slots and contain a passage in which a female contact is disposed. Each member in each module is bracketed with a shield member and dielectric spacer. A conductive shield member of a different configuration is positioned between adjacent modules. While the shield members shield adjacent modules, a corrugated conductive member is positioned in the slots between the fingers to shield adjacent female contact disposed in the passages in the several fingers. The shield members and corrugated member are connected to ground circuits to complete the ground paths.

It is now proposed to provide ground reference contacts in high density, high frequency two-piece connectors wherein the ground reference contacts provide shielding between adjacent columns of signal carrying contacts. It is further proposed to provide power-carrying contacts in conjunction with ground reference contacts where required.

SUMMARY OF THE INVENTION

According to the invention, a two piece, high density electrical connector system is provided with ground contacts between columns of signal contacts with the ground contacts of one connector having outwardly projecting blades and the mating ground contacts of the other connector including plates with cantilever beams, the plates providing a shield between columns of mated signal contacts and the cantilever beams electrically engaging the blades to complete ground circuits between backplanes and circuit cards associated with the two connectors.

BRIEF DESCRIPTION OF THE DRAWINGS

FIGS. 12A, 12B are perspective views of yet another embodiment of conductive contacts for use in the second connector;

FIGS. 13A, 13B are plane views showing other embodiments of signal contacts for use in the second connector;

DESCRIPTION OF THE INVENTION

The electrical connector system of the present invention includes a first connector known in the art as a "pin header" and which is normally mounted on a mother board or backplane. The system further includes a second connector, known as a "receptacle", which plugs into or mates with the pin header and on which is mounted a printed circuit board commonly referred to as a "daughter card". The connectors have conductive contacts which carry signals between circuits on the card and backplane.

The electrical connector system disclosed herein is based on the high density interconnect system made and sold by AMP Incorporated of Harrisburg, Pa. The two-piece connectors have two or more columns of signal contacts and are sold under the product identifier of "HDI".

Figure 1:
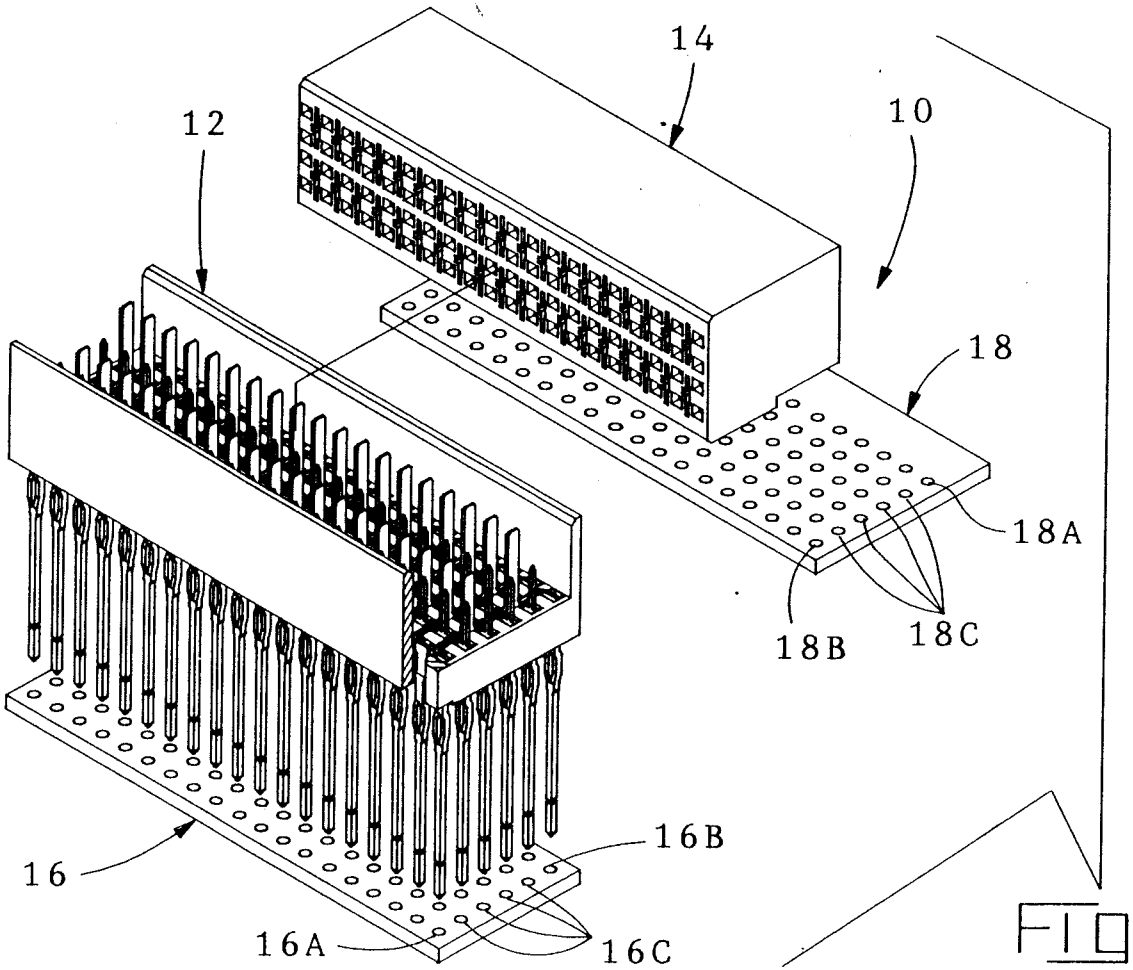
FIG. 1 is a perspective view of the electrical connector system constructed in accordance with the present invention.

Electrical connector system 10 shown in FIG. 1 includes first connector 12, mounted on backplane 16 and second connector 14 with its daughter card 18 adjacent thereto.

Connector 12 includes dielectric housing 20 having base 22 and sidewalls 24 and 26. End walls are not shown but can be added. Further included are power contacts 28, ground contacts 30 and signal contacts 32.

FIGS. 2A, 2B, 2C and 2D illustrate the structure of housing 20 in more detail. Sidewalls 24 and 26 define, in conjunction with floor 34, cavity 36. A column 38 and row 40 configuration of passages 42, 44 and 46 are provided in housing 20 which extend through base 22, opening onto floor 34 and lower surface 48. Passages 42 are adjacent sidewall 24, passages 44 are adjacent sidewall 26 and passages 46 are positioned therebetween. As shown, each column 38 includes one passage 42, one passage 44 and four passages 46. The interior details of passages 42, 44 and 46 are not shown as such depend upon the type of retention means used to retain contacts 28, 30 and 32 therein, and as these matters are well known to those skilled in the art, such details are not required in order to practice the present invention.

Figure 2A:
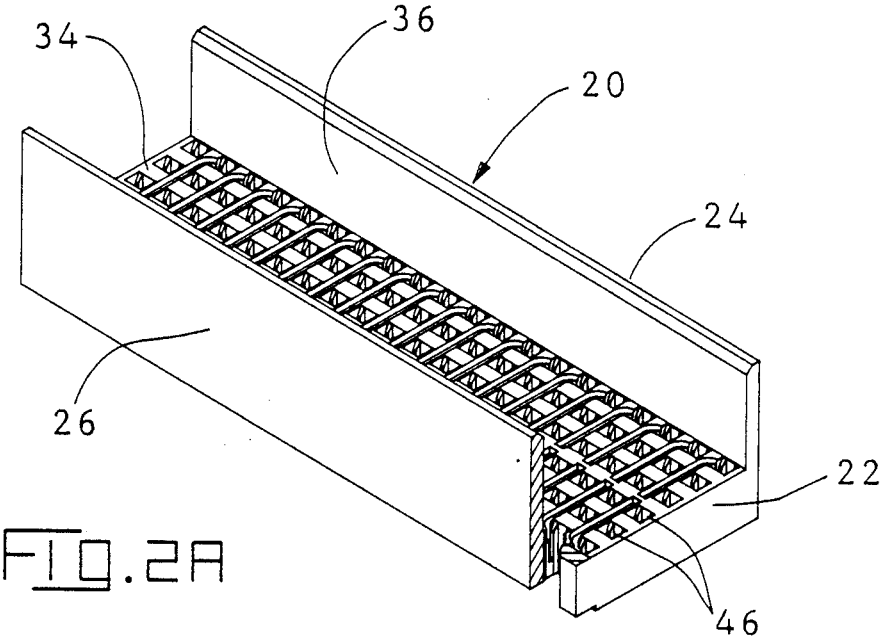
FIGS. 2A–2D are various views of the housing of the first connector of the system.
Figure 2B:
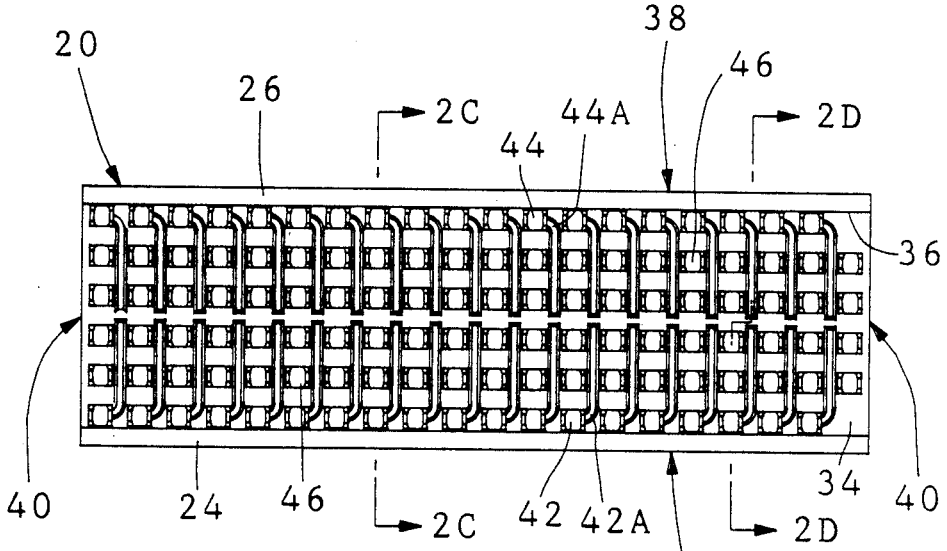
Figure 2C:
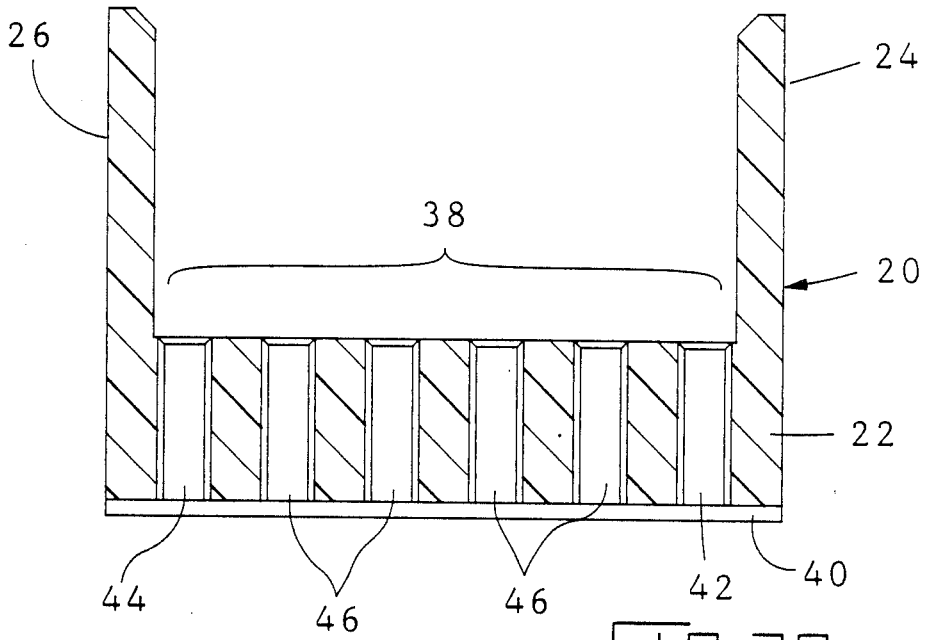
Figure 2D:
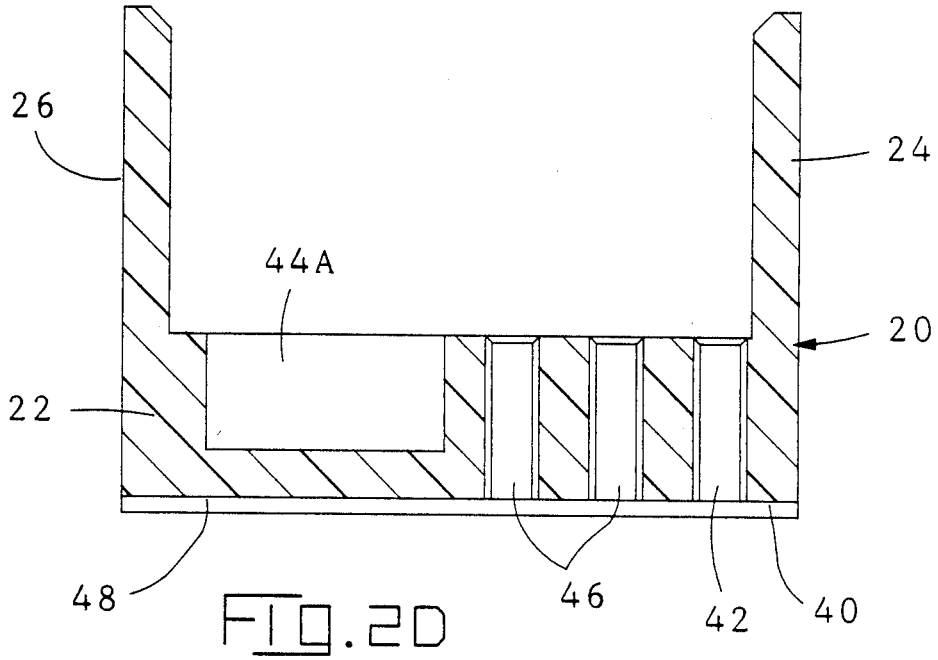

Associated with passages 42 and 44 are channels **42*a* and 44*a* respectively which curve inwardly between adjacent columns 38 and extend towards the center of cavity 36. As shown in FIG. 2D, channels 42*a* and 44*a* extend into but do not go through base 22**.

Housing 20 is preferably molded, using a plastic material such as a high temperature thermoplastic.

Figure 3A:
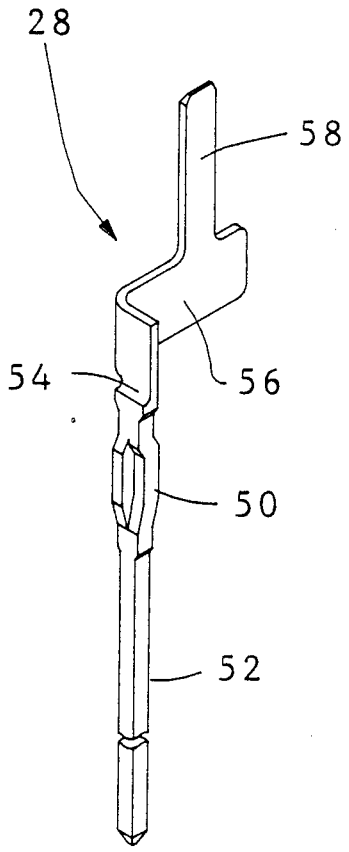
FIGS. 3A–3C are perspective view illustrating the conductive contacts of the first connector.
Figure 3B:
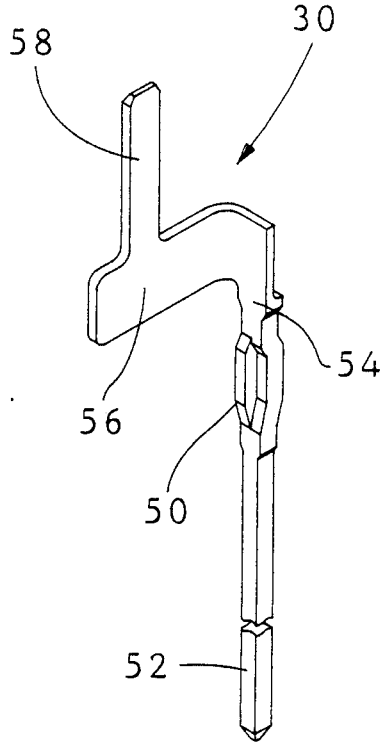
Figure 3C:
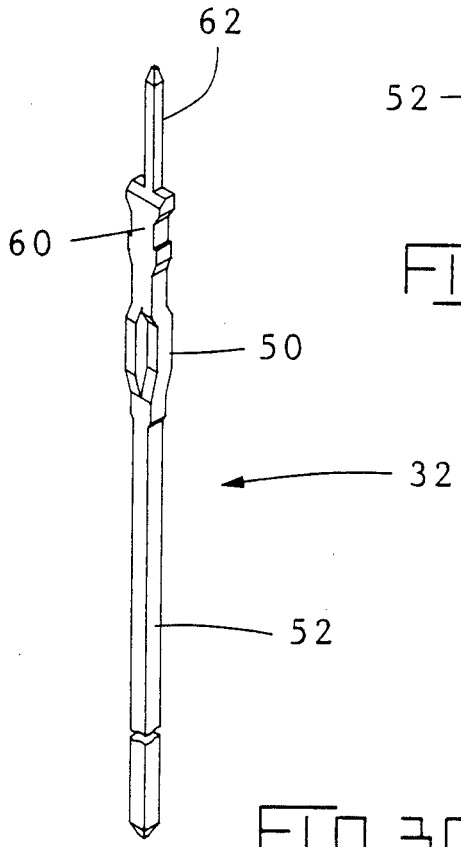

Contacts 28, 30 and 32, shown in FIGS. 3A, 3B and 3C, include in common, compliant section 50 and lead 52. Power and ground contacts 28 and 30 respectively include retaining section 54, L-shaped straps 56 and blades 58. As shown, straps 56 on respective contacts 28 and 30 curves in opposite directions relative to each other and serve to offset blades 58 relative to compliant section 50, leads 52 and retaining sections 54. Blade 58 on ground contact 28 is longer than blade 58 on power contact 30, a common practice in the art.

Signal contact 32 further includes retaining section 60 and pin 62.

Contacts 28, 30 and 32 are preferably stamped and formed with the preferred material being phosphor bronze.

Figure 4A:
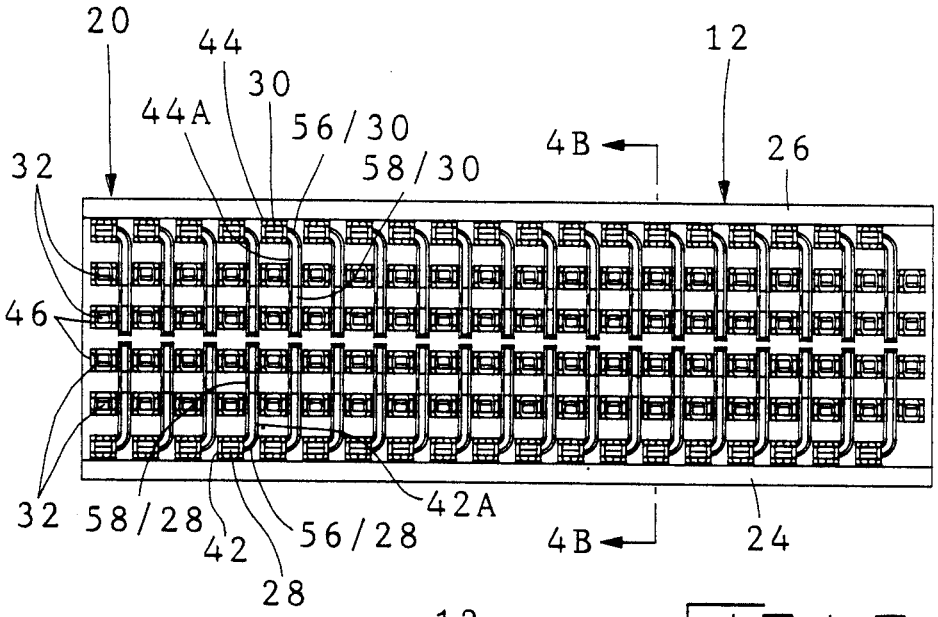
FIGS. 4A, 4B are views showing the first connector.
Figure 4B:
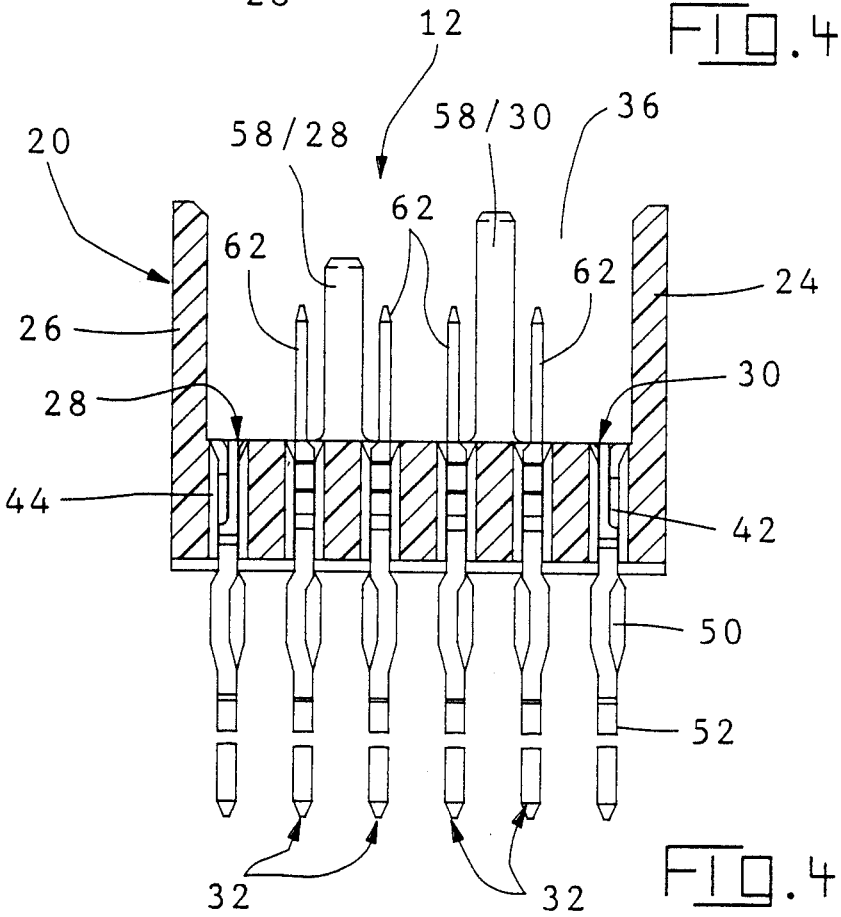

FIGS. 4A and 4B illustrate the positioning of contacts 28,30 and 32 in housing 20 to form first connector 12.

Power contacts 28 are positioned in passages 44 adjacent sidewall 26 with straps 56 thereon being received in channels **44*a***.

Ground contacts 30 are positioned in passages 42 adjacent sidewall 24 with straps 56 being received in channels **42*a***.

Signal contacts 32 are positioned in passages 46 with pins 62 projecting into cavity 36.

Compliant sections 50 and leads 52 of all contacts 28, 30 and 32 extend outwardly from housing lower surface 48 with section 50 being adapted for a frictional fit into plated through holes **16*a*, 16*b* and 16*c* in backplane 16 and leads 52, which project beyond backplane 16**, being adapted for wire wrapping purposes.

Second connector 14 includes dielectric housing 70, power contacts 72, ground contacts 74 and signal contacts 76. FIGS. 5A–5D illustrate the structure of housing 70 in detail.

Figure 5A:
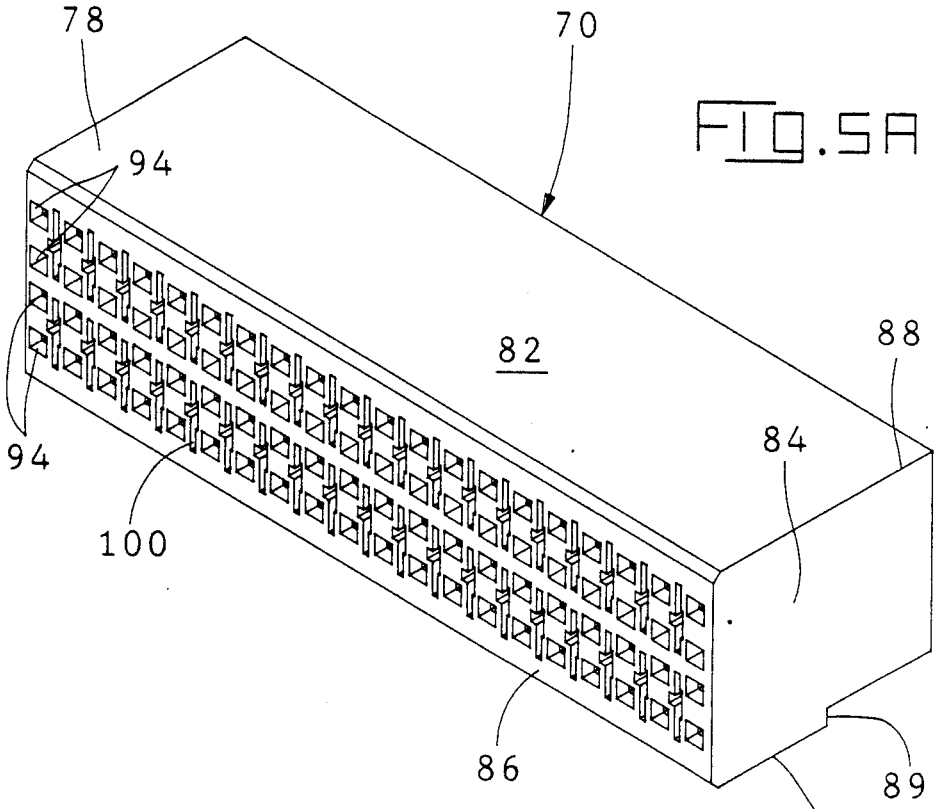
FIGS. 5A–5D are various views of the housing of the second connector of the system.
Figure 5B:
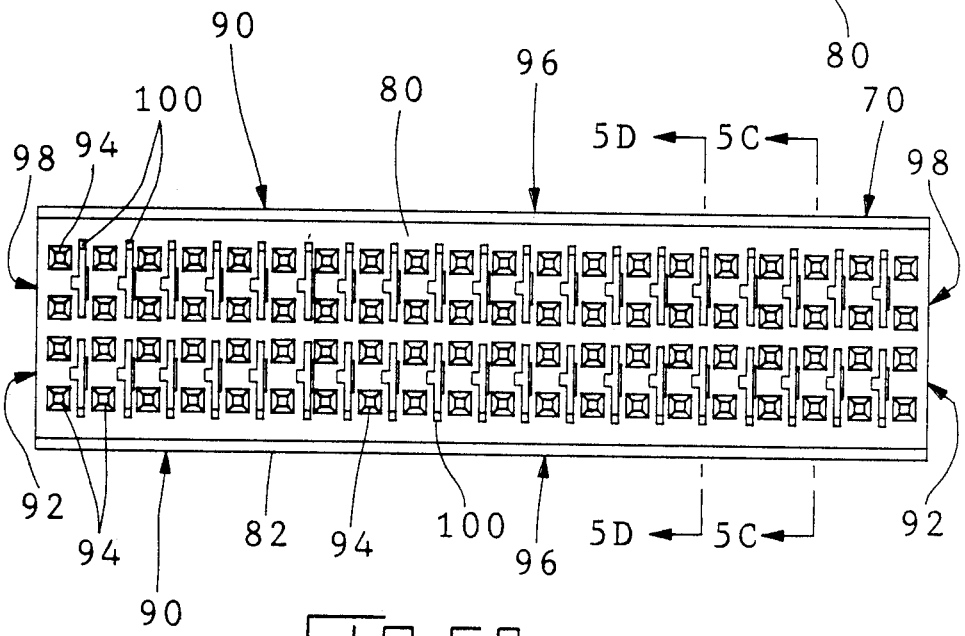
Figure 5C:
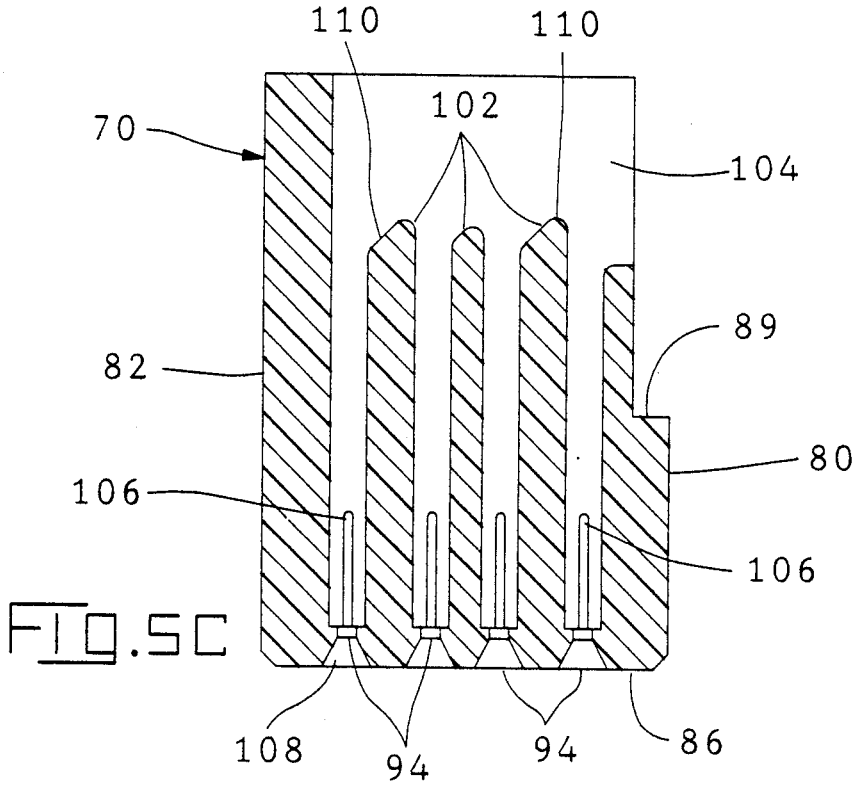
Figure 5D:
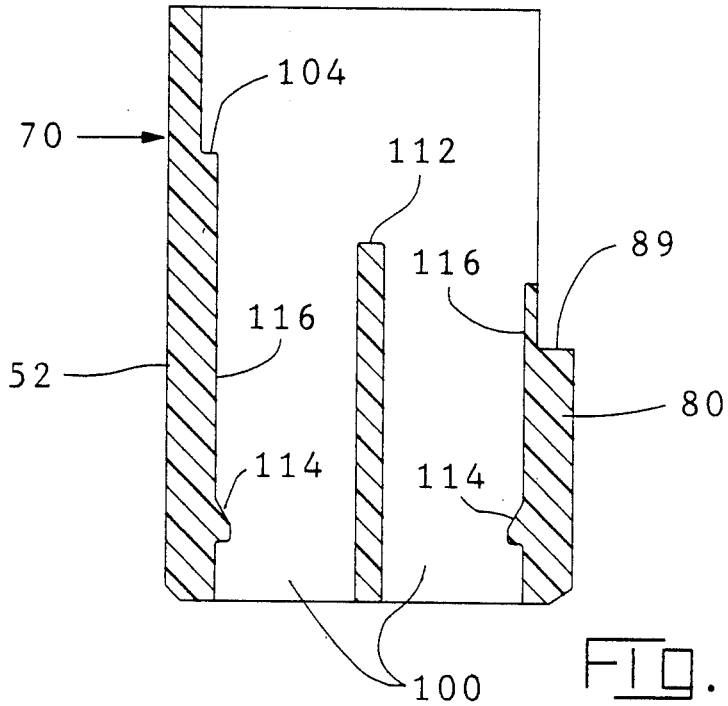

Housing 70 is a rectangular block 78 with opposing sides 80 and 82, ends 84, front surface 86 and a rear face 88. As seen in FIGS. 5C and 5D, side 80 extends rearwardly from front surface 86, a shorter distance relative to opposing side 82 and includes ledge 89.

A column 90 and row 92 (FIG. 5B) configuration of passages 94, provided in housing 70, open on front surface 86 and rearwardly. Further, a column 96 and row 98 (FIG. 5B) configuration of slots 100, provided in housing 70, open on front surface 86 and also rearwardly. The columns of four passages 94 alternate with columns of two slots 100 along the length of housing 70.

Each passage 94 is isolated from other passages 94 by interior walls 102 and from slots 100 by transverse walls 104. As seen in FIG. 5C, beam spreaders 106 project into respective passages 94 from each transverse wall 104. Openings 108 of passages 94 are preferably funnel-shaped. The free ends 110 of walls 102 are beveled on one side as shown with the beveled extending rearwardly and towards side 80.

Slots 100 in each row 96 are separated by wall 112. Further, noses 114 project into respective slots 100 from inside surfaces 116 of respective sides 80 and 82. Rearwardly facing ledge 117 is provided on the inside surface 116 of side 82.

Housing 70 is preferably molded with the preferred material being a high temperature thermoplastic.

Figures 6A, 6B:
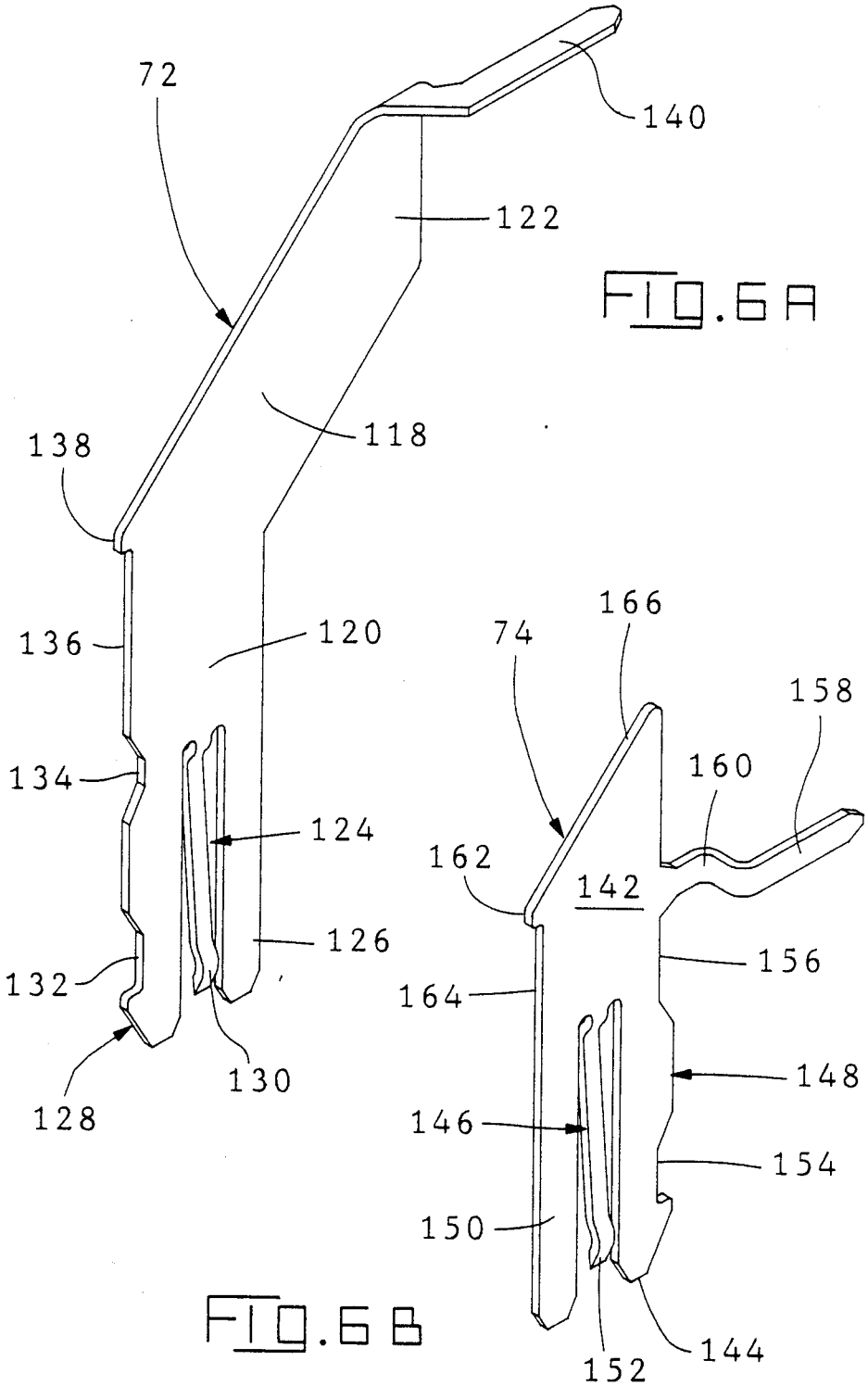
FIGS. 6A–6C are perspective views of the conductive contacts of the second connector.
Figure 6C:
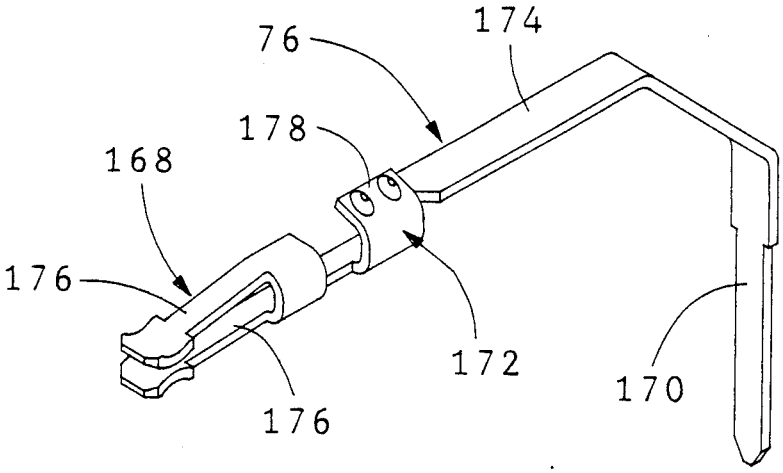

Contacts 72,74 and 76 which are associated with second connector 14 are shown in FIGS. 6A,6B and 6C respectively. These contacts are preferably stamped and formed from beryllium copper.

Power contact 72 (FIGS. 6A) includes flat plate 118 with the front end of front portion 120 slotted to provide cantilever beam 124 and fingers 126 and 128 on respective sides thereof. Beam 124 includes convex contact surface 130 at the free end thereof and further is bent out in one direction from the plane of plate 118 adjacent the point of attachment thereto. It is then bent in the opposite direction so that the beam crosses the plane of plate 118, placing convex contact surface 30 on the other side of plate 118. Notches 132 and 134 are provided in outwardly facing side edge 136 of plate 118 with the former being near the free end of finger 128. Tab 138 projects outwardly from edge 136 at the junction between front and rear portions 120 and 122 respectively.

Rear portion 122 is in the same plane as but is formed at an angle relative to front portion 120 with the angle being about forty five degrees. Projecting outwardly from a corner of rear portion 122 is lead 140 which is bent out of the plane of plate 118 so as to be at right angles thereto and accordingly offset therefrom.

Ground contact 74 (FIG. 6B) includes flat plate 142 wherein the forward free end 144 is slotted to define cantilever beam 146 bracketed by fingers 148 and 150 on respective sides. Beam 146 includes a convex contact surface 152 at the free end thereof, and as with beam 124 on contact 72, is bent to cross plate 142 from one surface to the other. Notch 154 is provided in outwardly facing side edge 156 of plate 142 near the free end of finger 148. Further rearwardly, lead 158 projects outwardly from edge 156 after being displaced out of the plane of plate 142 by offsetting strap 160. Tab 162 projects outwardly from opposite side edge 164 at the corner of the rear edge 166 of plate 142. As shown, rear edge 166 is at an angle relative to side edges 156 and 164.

The offsetting of leads 140 and 158 is required because of the hole pattern in card 18; i.e. power and ground holes **18*a* and 18*b* respectively are in line with signal holes 18*c* (FIG. 1**).

Signal contact 76 (FIG. 6C) includes receptacle 168 at one end, lead 170 at the opposite end, retaining section 172 behind receptacle 168 and strap 174 which extends between and connects lead 170 to section 172. Receptacle 168 is formed from opposing resilient beams 176. Retaining section 172 includes an obliquely outwardly extending resilient leg 178. Strap 174 is bent forty five degrees at two spaced-apart locations to position lead 170 at a ninety degree angle relative to receptacle 168.

Figure 7A:
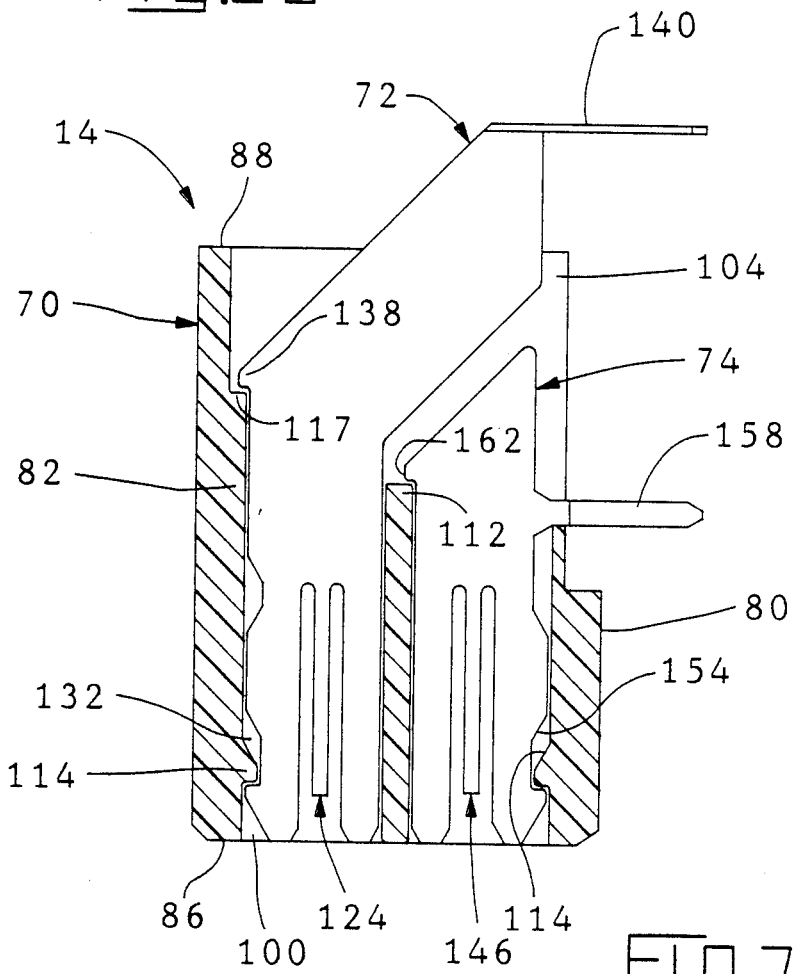
FIGS. 7A,7B are cross-sectional views of the second connector.
Figure 7B:
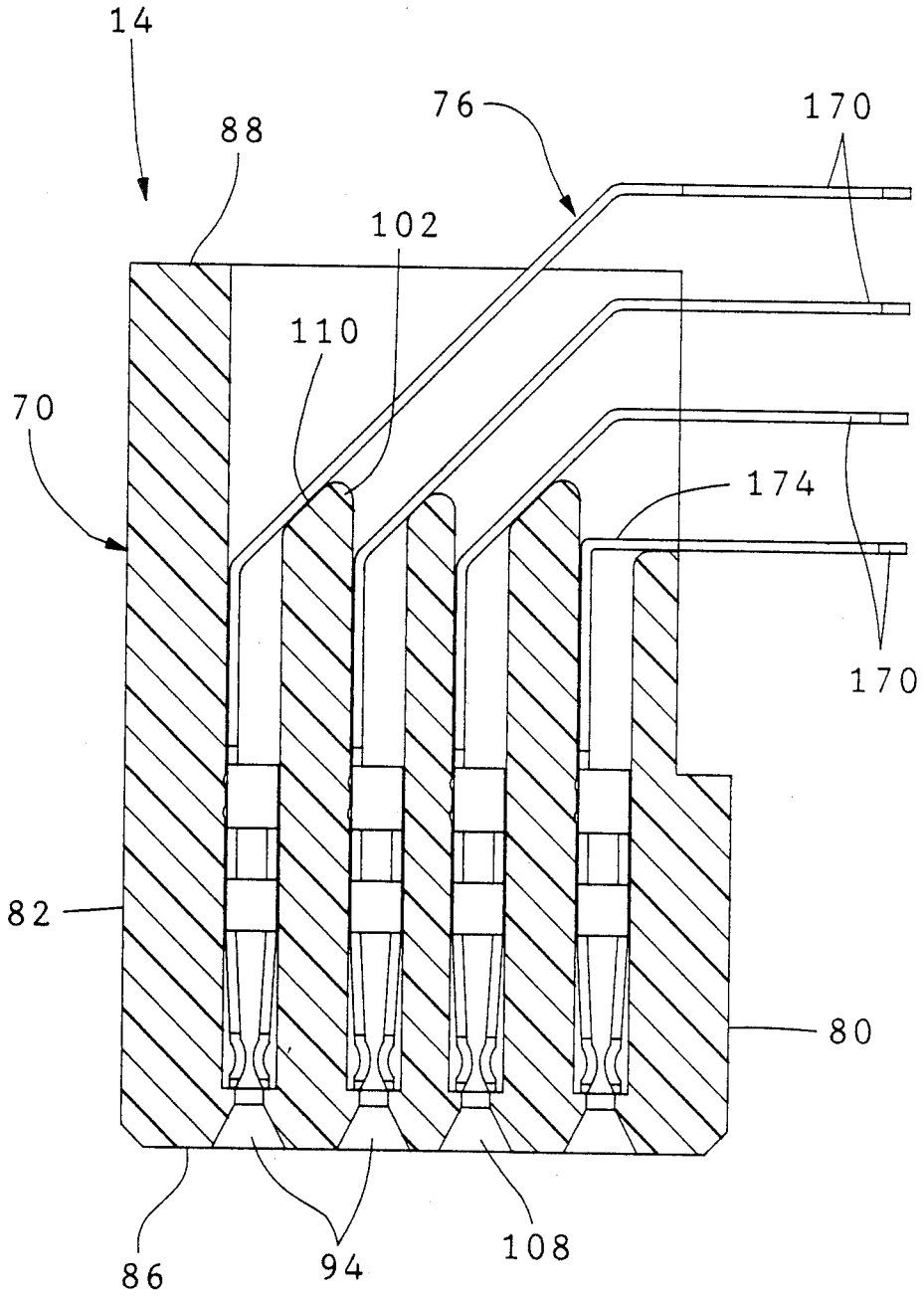

FIGS. 7A and 7B illustrate the positioning of contacts 72, 74 and 76 in housing 70 to form second connector 14.

Power contacts 72 (FIG. 7A) are inserted, from rear face 88, into slots 100 which are adjacent side 82. Cantilever beams 124 are adjacent front surface 86 and leads 140 project laterally from housing 70 on the same side as side 80. Retention is accomplished by nose 114 entering notch 132 and tab 138 engaging ledge 117.

Ground contacts 74 (FIG. 7A) are also inserted from rear face 88 into slots 100 adjacent side 80. Cantilever beam 146 is adjacent front surface 86 and lead 158 projects laterally from housing 70 between lead 140 on contact 72 and side 80. Retention is provided by nose 114 entering notch 154 and tab 162 engaging the end of wall 112.

Signal contacts 76 (FIG. 7B) are inserted into passages 94 from rear face 88 with receptacles 168 being adjacent openings 108. Leads 170 project laterally from housing 70 on the same side as side 80. Retention is by an interference fit between passages 94 and retaining sections 172. Straps 174 bear against beveled ends 110 of walls 102 except for contacts 76 positioned in the passage 94 adjacent side 80. In this case, strap 174 is bent once ninety degrees and it rests on the free end of side 80.

Leads 140, 158 and 170 are adapted for insertion into holes **18*a*, 18*b* and 18*c* respectively of card 18** and retained therein by soldering.

Figure 8A:
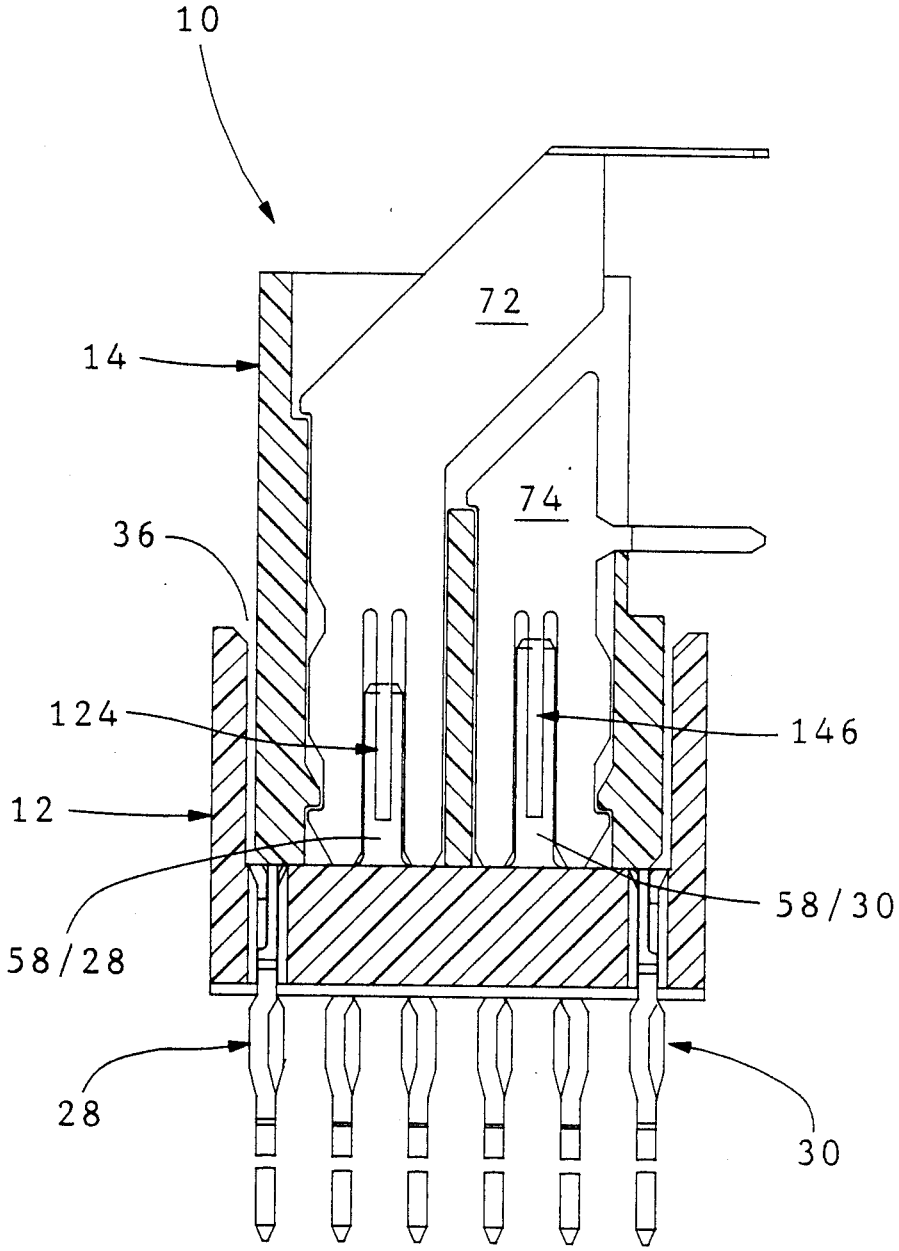
FIGS. 8A,8B are cross-sectional views of the mated first and second connectors.
Figure 8B:
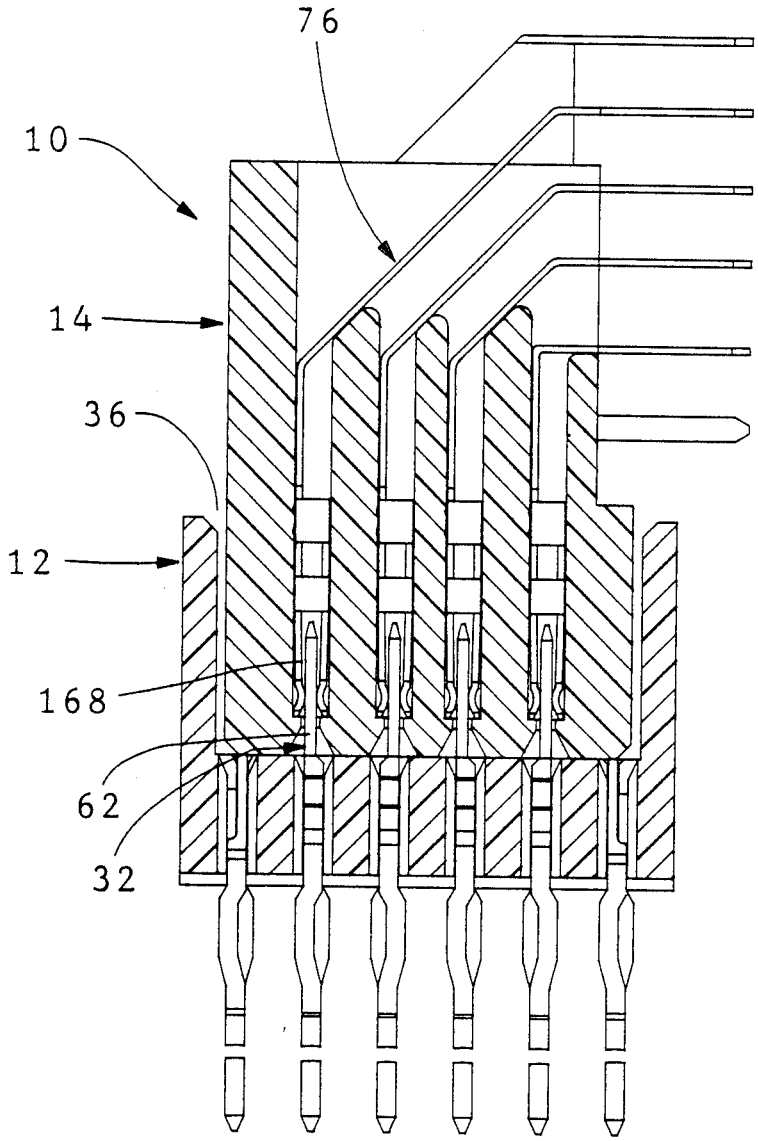

FIGS. 8A and 8B illustrate connectors 12 and 14 engaging one another. Connector 14 is placed into cavity 36 of connector 12 so that contacts 72, 74 and 76 respectively electrically engaged contacts 28, 30 and 32 in connector 12. More particularly, as shown in FIG. 8A, cantilever beams 124 and 146 on power and ground contacts 72 and 74 respectively slidingly engage blades 58 on power and ground contacts 28 and 30. The resilient deformation of cantilever beams 124 and 146 noted above provides the needed normal force against blades 58. As shown in FIG. 8B, pins 62 on signal contacts 32 in connector 12 enter receptables 168 on signal contacts 76 in connector 14.

FIGS. 9A–9D illustrate a modification to first connector 12. Housing 180 of modified first connector 182 includes separate columns 184 each with a power passage 186 and ground passage 188. Column 184 alternate with column 190 of four signal passages 46 each. Channels **186*a* and 188*a* extend straight inwardly towards each other from respective passages 186 and 188**.

Figure 9A:
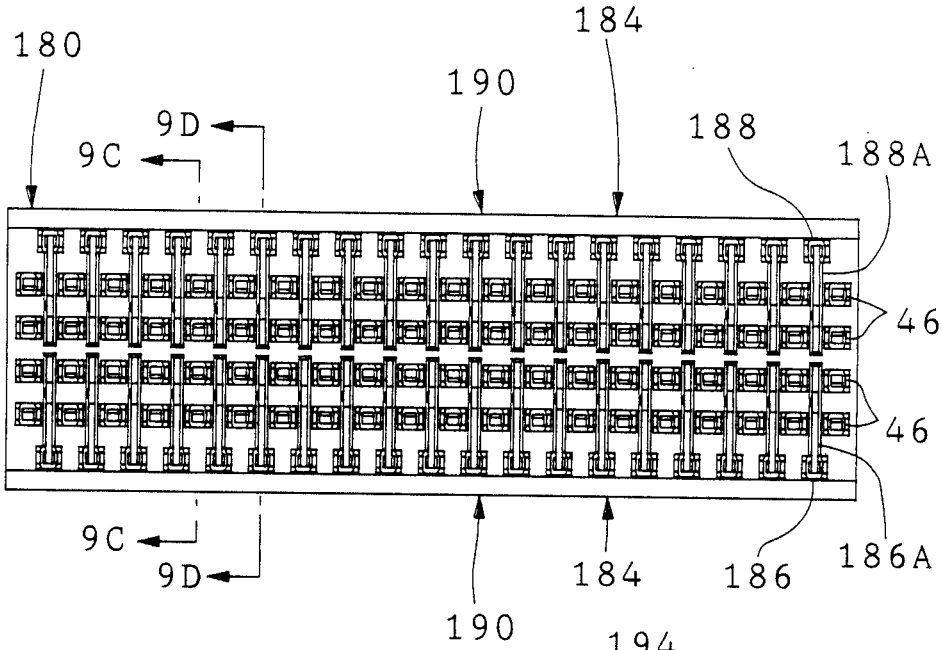
FIGS. 9A–9D are various views showing another embodiment of the first connector.
Figure 9B:
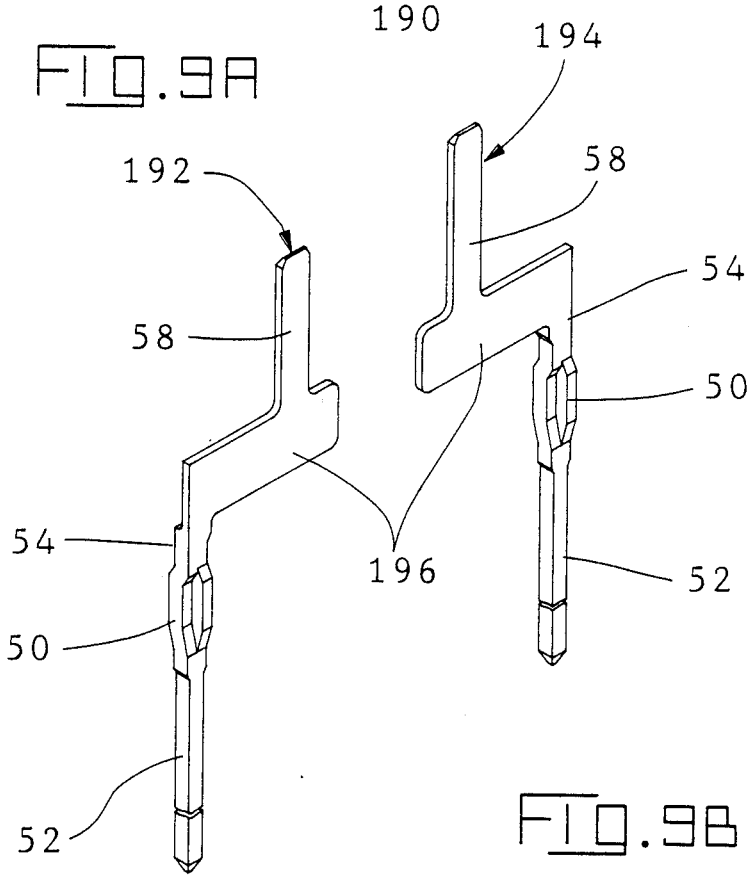

Power contact 192 and ground contact 194 for use in housing 180 are shown in FIG. 9B. Each contact 192 and 194 includes compliant section 50, lead 52, retaining section 54 and blade 58 with the latter component being offset from the first three by a straight strap 196.

Figure 9C:
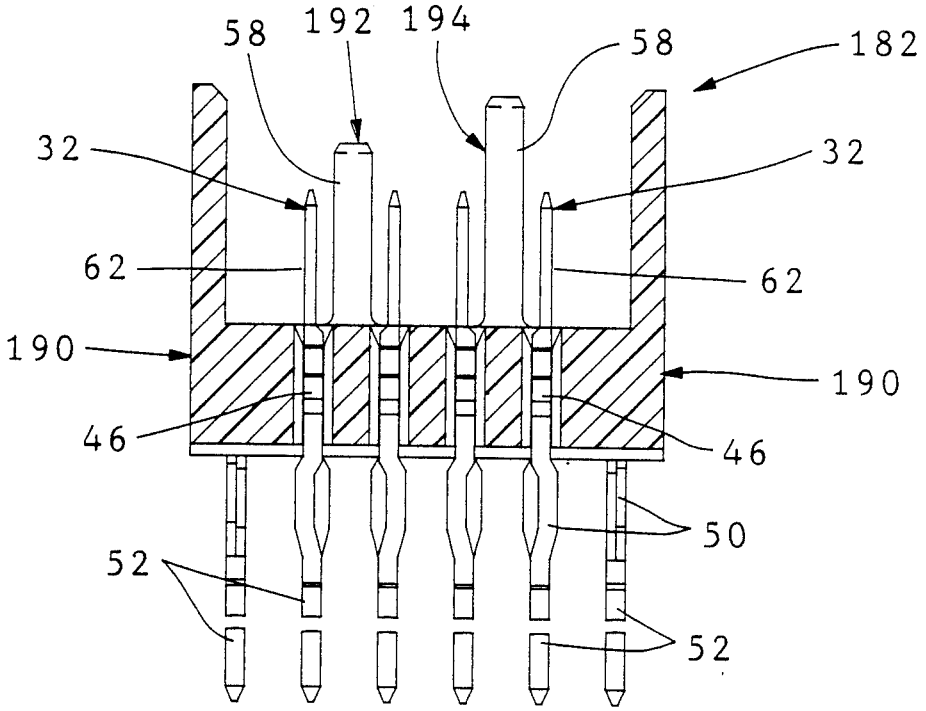
Figure 9D:
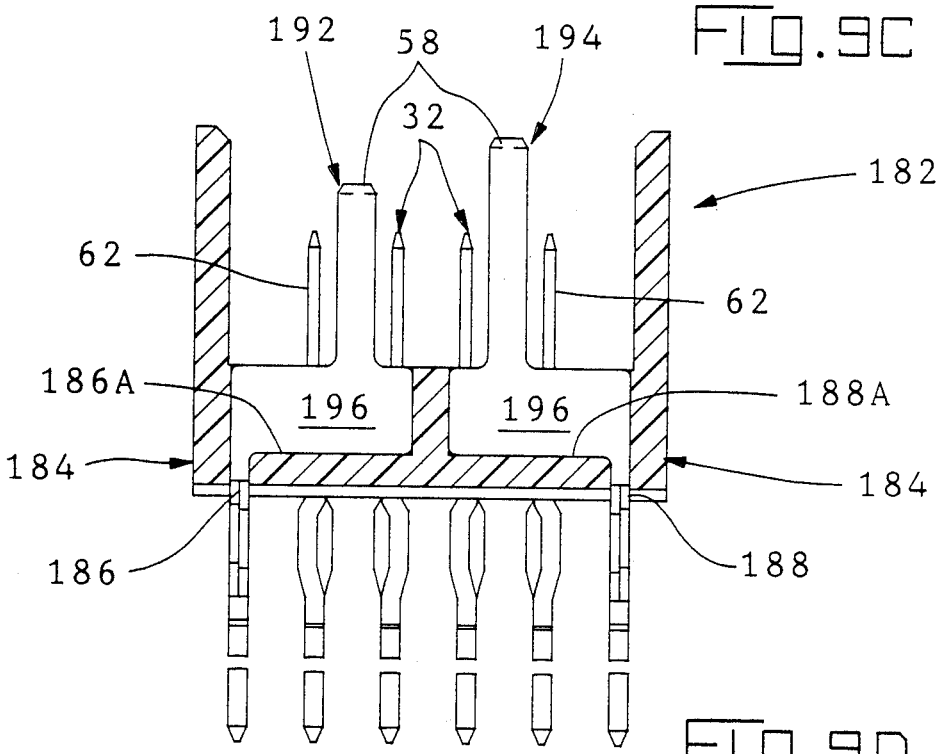

FIG. 9C shows connector 182 with a column 190 of signal contacts 32 in passages 46 and FIG. 9D shows connector 182 with a column 184 of one power contact 192 and one ground contact 194. Retaining sections 54 are positioned in respective passages 186 and 188 and straps 196 are positioned in respective channels **186*a* and 188*a*. These views show that pins 62 on contacts 32 are in the same relation with blades 58 on respective contacts 192 and 194 as with first connector 12. Accordingly, first connectors 12 and 182 are interchangeable; i.e., each can be used with second connector 14** without modification thereto.

Figure 10A:
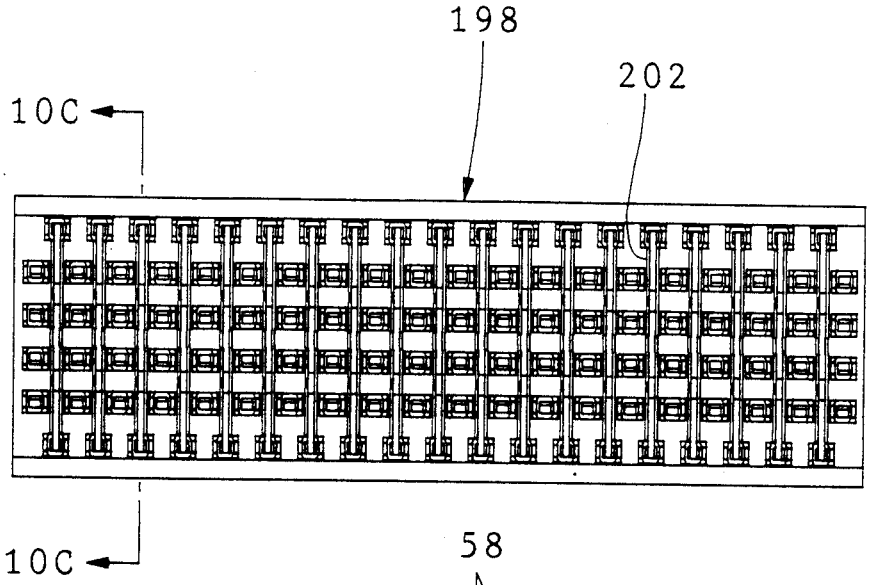
FIGS. 10A–10C are various views showing yet another embodiment of the first connector.
Figure 10B:
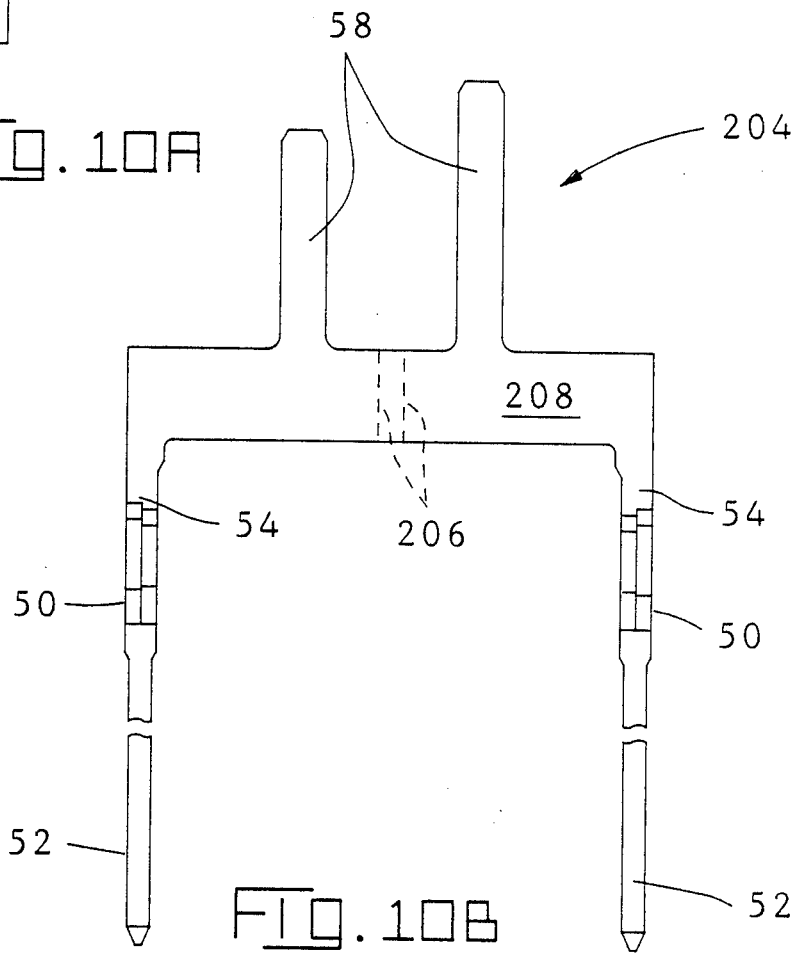
Figure 10C:
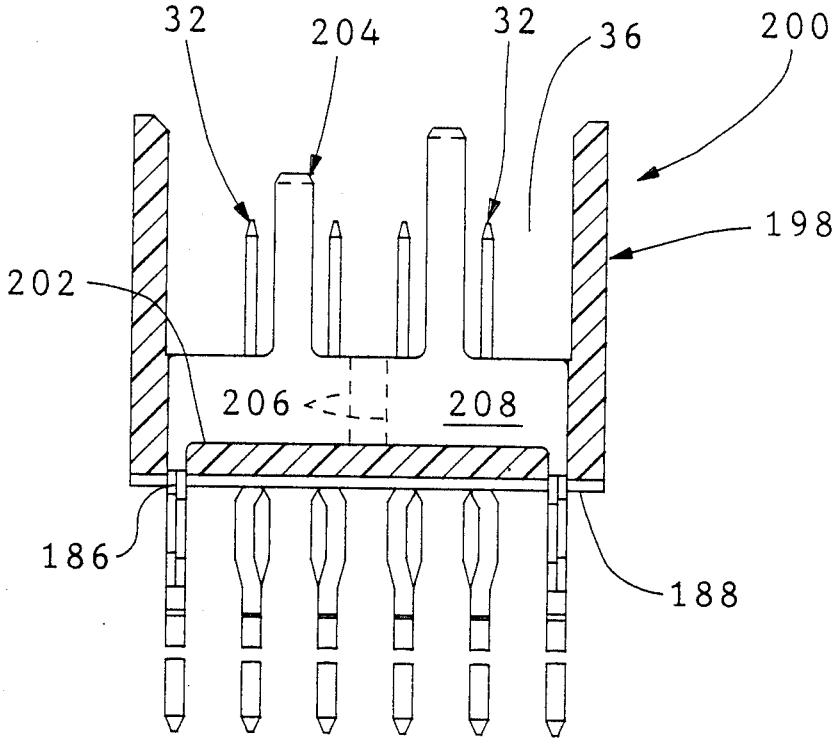

FIGS. 10A, 10B and 10C illustrate a modification to first connector 182 and contacts 192 and 194. Channels **186*a* and 188*a* in housing 198 of first connector 200 continue inwardly and join each other; to form a single channel 202 which extends across the width of cavity 36 and interconnects passages 186 and 188 as shown in FIGS. 10A. Contacts 192 and 194 are modified by being made as a single unit as shown in FIG. 10B and indicated by reference numeral 204. Double score lines 206 are provided across the width of strap 208 intermediate the ends so that contact 204 may be separated into contacts 192 and 194 by breaking strap 208 along score lines 206**.

FIG. 10C shows contact 204 positioned in respective passages 186 and 188 and strap 208 in channel 202 in housing 198 to form first connector 200.

Contact 204 permits the user to dedicate it to an all ground use, an all power use or to separate it into aforementioned contacts 192 and 194.

Figure 11A:
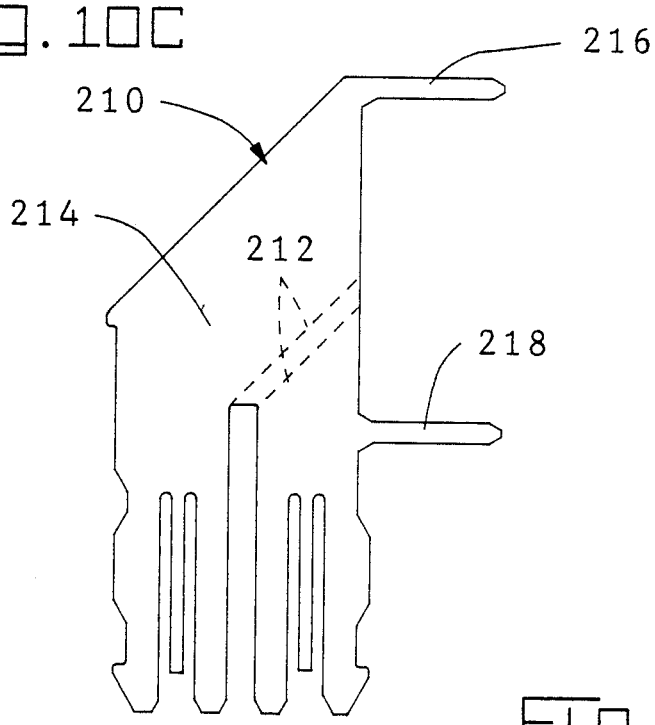
FIGS. 11A, 11B are views showing another embodiment of conductive contacts for use in the second connector.
Figure 11B:
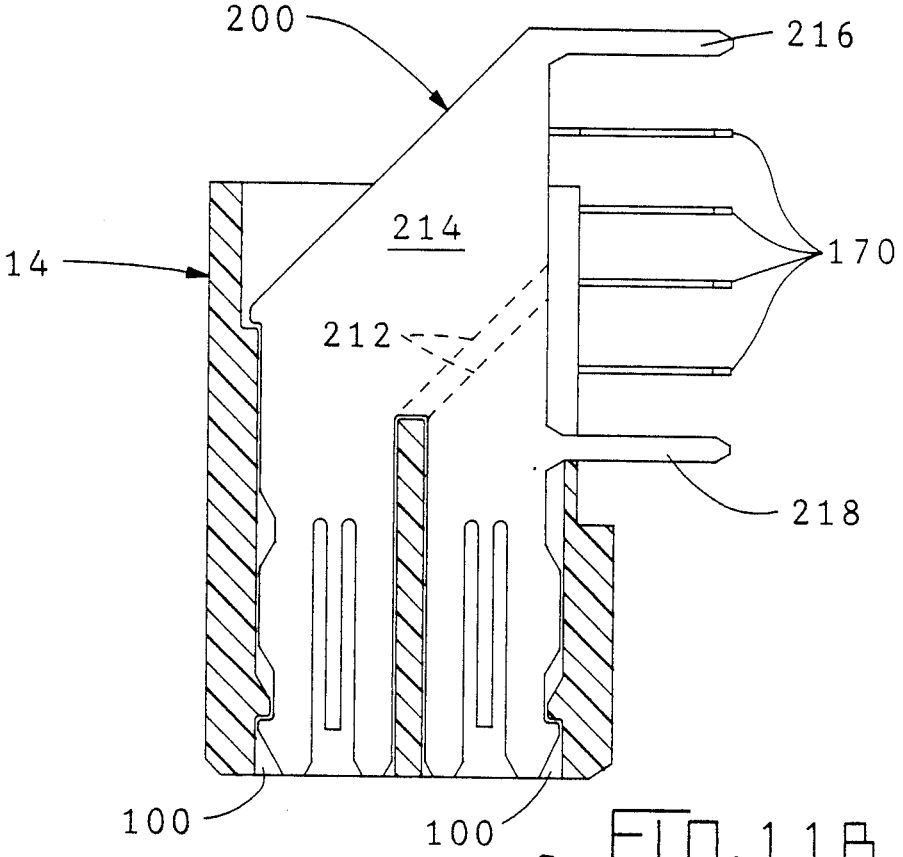

As with contact 204, contacts 72 and 74 can also be formed into a single contact 210 shown in FIGS. 11A, 11B and 11C. Double score lines 212 are provided on plate 214 permitting the user the option of breaking contact 210 into separate contacts.

Contact 210 includes another modification vis-a-vis contacts 72 and 74. Leads 216 and 218 project outwardly from and on the same plane as plate 214. This contrast to leads 140 and 158 which are offset so as to engage holes **18*a* and 18*b* in card 18 (FIG. 1). The use of leads 216 and 218 require that holes 18*a* and 18*b* be staggered (not shown) relative to signal holes 18*c*. Leads 216 and 218 can be formed off-setting plate 214** however if desired.

FIG. 11B shows contact 210 positioned in second connector 14. The use of contact 210 in second connector 14 does not require the modification thereof or of first connectors 12, 182 and 200.

Figure 12A:
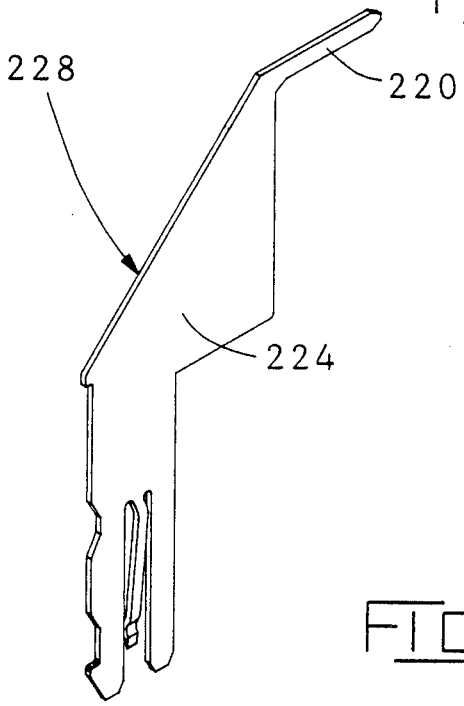
Figure 12A:
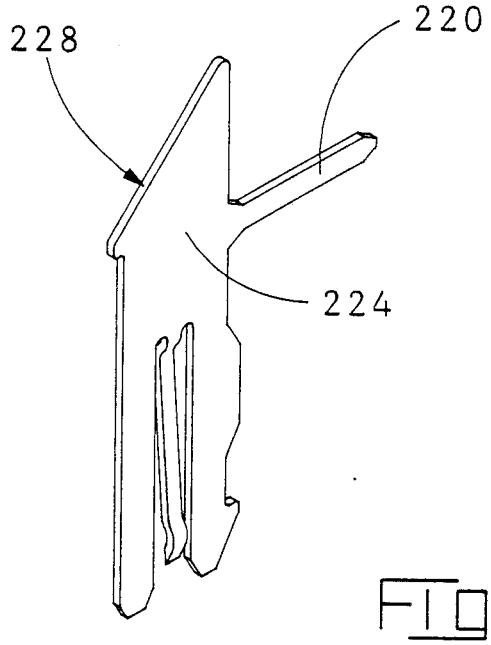

FIGS. 12A and 12B illustrate a modification to contacts 72 and 74 as noted above with respect to contact 210; i.e., leads 220 and 222 are on the same plane as plates 224 and 226 of respective contacts 228 and 230. As noted above, the use of leads 220 and 222 require a modification (not shown) to the hole arrangement on card 18. In all other respects, leads 220 and 222 are the same as leads 72 and 74.

Figure 13B:
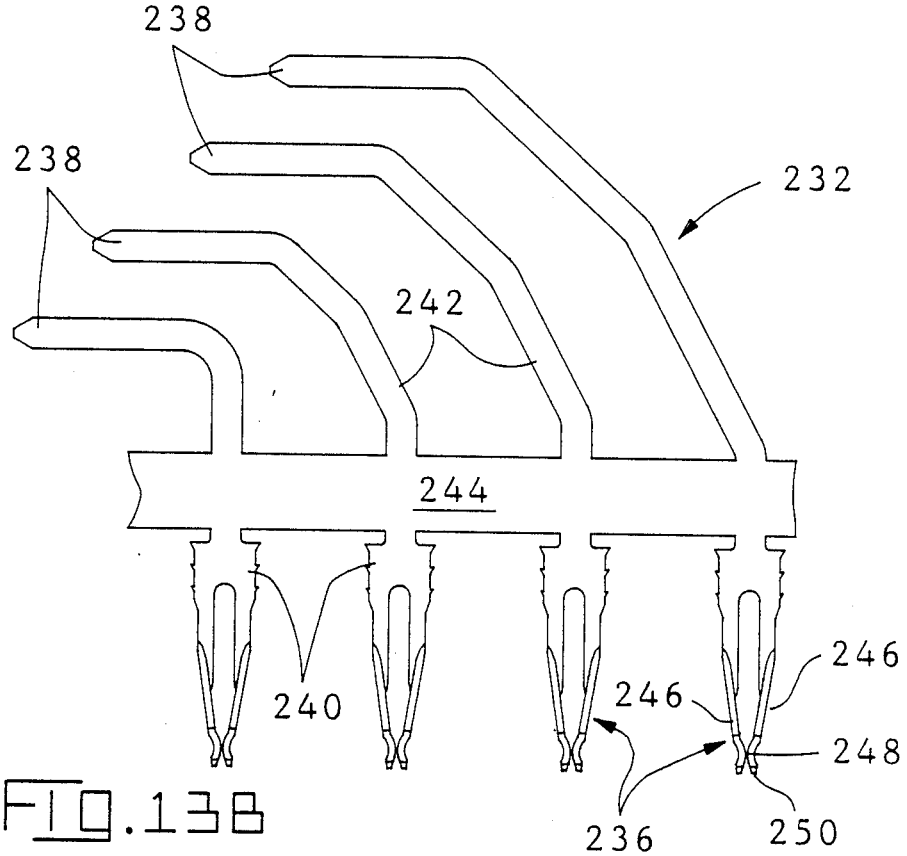
Figure 13B:
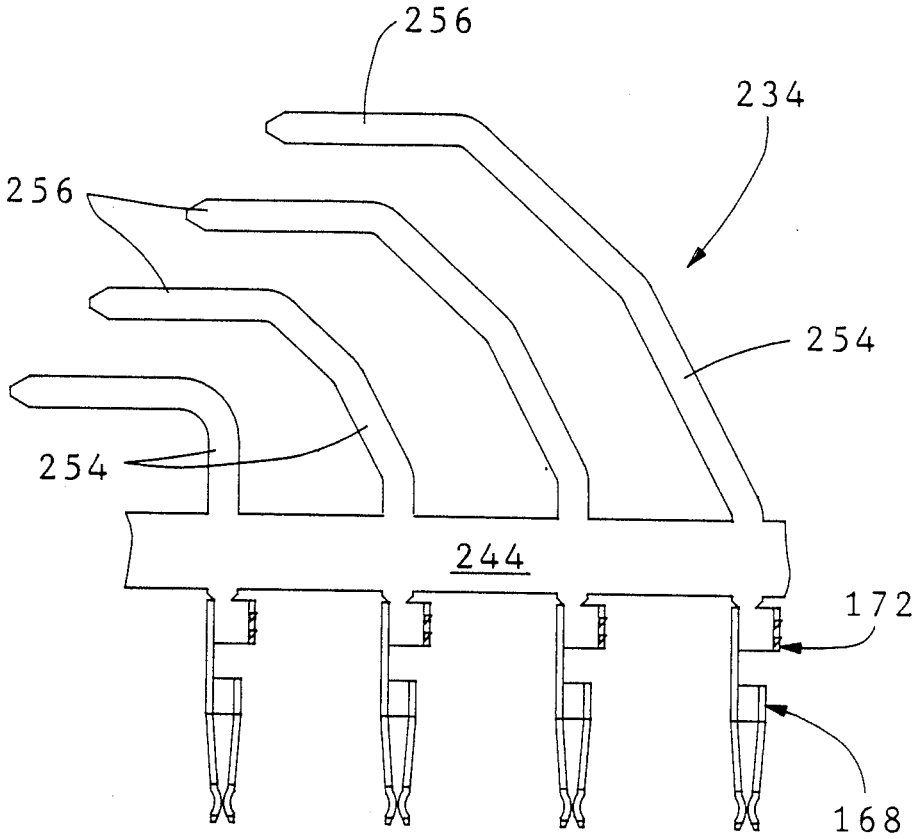

FIGS. 13A and 13B illustrate signal contacts 232 and 234 respectively which can be used in second connector 14.

Contacts 232 include receptacle 236 at one end, lead 238 at the opposite end and retaining section 240, strap 242 and carrier strip 244 in between.

Contacts 232 are stamped and formed from flat stock, and except for beams 246 of receptacle 236, remains in a flat shape. Beams 246 are folded up out of the plane of the rest of the contact 232, and converge at convex surfaces 248 adjacent free ends 250. One advantage of forming contacts 232 in this manner is that convex surfaces 248 can be accurately plated prior to being folded up.

Retaining section 240 includes barbs 252 which dig into the walls defining passages 46 to retain contacts 232 in housing 70.

Figure 14:
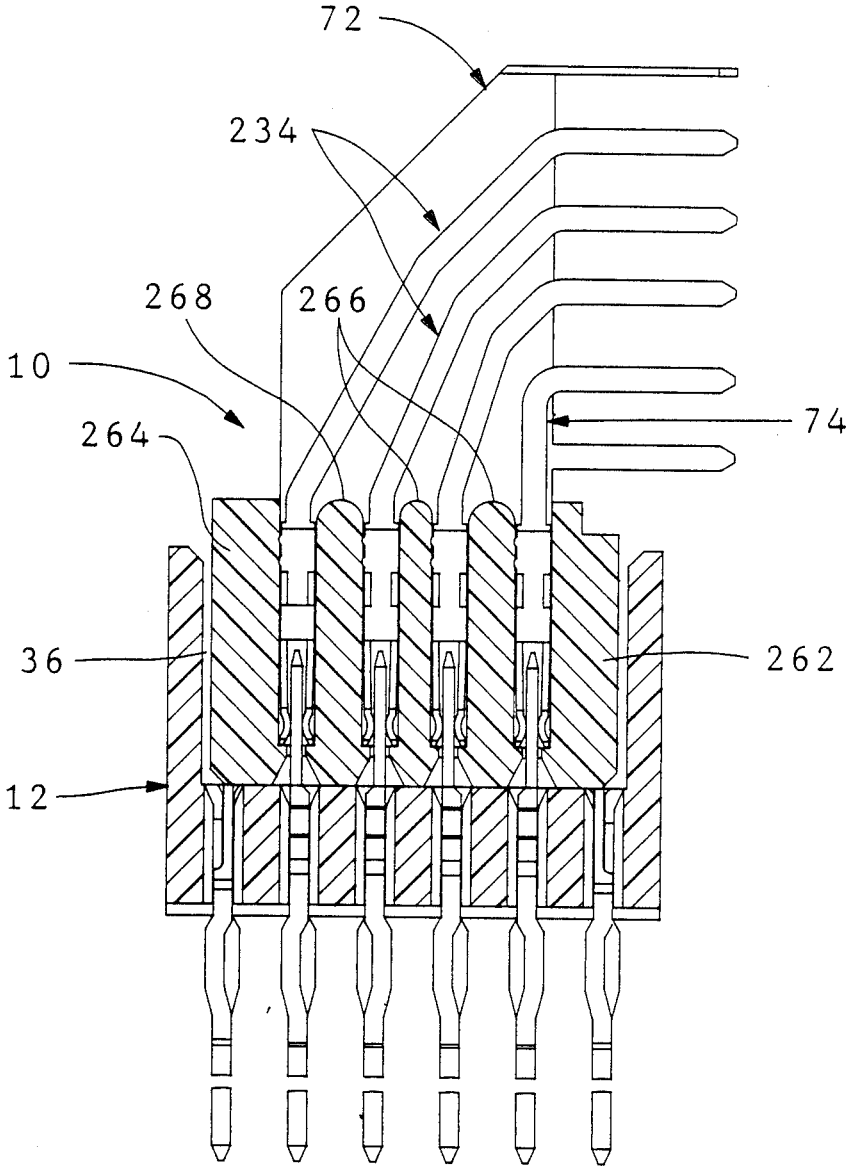
FIG. 14 is a cross-sectional view of another embodiment of the second connector mated with a first connector.

Contacts 232 are positioned in housing 70 so that the width of leads 238 and straps 242 are normal to the longitudinal axis of second connector 14 such as shown with respect to contacts 234 in FIG. 14. This is opposite the positioning of leads 170 and straps 174 on contacts 76 as shown in FIG. 7B.

As is well known in the art, contacts 232 are cut away from carrier strip 244 prior to being loaded into housing 70.

Contacts 234 shown in FIG. 13B retain the receptacles 168 and retaining section 172 of contacts 76 (FIG. 6C). Straps 254 and leads 256 retained in the same position as stamped, so that, as shown in FIG. 13C, the widths thereof are normal to the housing axis.

One advantage of contacts 232 and 234 is that the straps 242 and 254 do not need to be bent; i.e., the shape desired is obtained in the initial stamping operation.

As shown in FIG. 14, and as compared to housing 70 shown in FIG. 8B, housing 258 of second connector 260 has been modified to accept straps 242 and 254 of respective contacts 232 and 234. The modification includes reducing the width of housing 258 by reducing the length of sides 262 and 264, walls 266 and omitting a wall between columns 90 and columns 96. With first connector 12 providing a reference point, one can see that all of the aforementioned components, sides 262 and 264, walls 266, are much shorter than corresponding sides 80 and 82, walls 102. Further, free ends 268 are rounded rather than being beveled.

Figure 15:
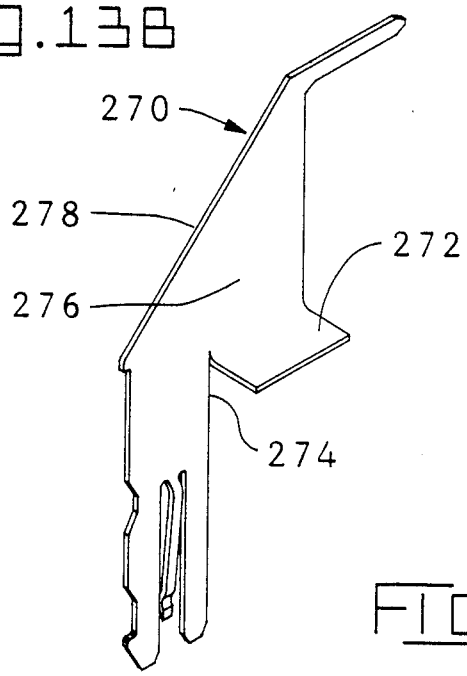
FIG. 15 is a perspective view of still another modification of a conductive contact.

FIG. 15 shows yet another modification to either contacts 72, 210 or 228. Contact 270 includes ear 272 which is shown attached to edge 274 and bent normal to plate 276. With contact 270 positioned in housing 258, ear 272 extends between a pair of adjacent straps 234 or 254 of respective contacts 232 and 234 in an adjacent column and thus isolates the two adjacent straps. Ear 272 may be placed on opposite edge 278 (not shown) as well as edge 274 to isolate other pairs of straps 242 and 254.

Several embodiments of some of the components comprising system 10 have been shown. Of these, the preferred first connector is connector 200 in conjunction with contacts 204. Should the user dedicate a contact 204 to ground, strap 208 provides a continuous shield across the width of cavity 36. Secondly, and so noted above, the user has the option of keeping contact 204 intact or separating it into two separate ones.

Housing 180 or 198 are preferred, apart from being able to use contacts 204, from the standpoint of staggering passages 186 and 188 relative to signal passages 46 and from the standpoint of ease in molding straight channels **186*a*, 188*a* and 202 as opposed to curved channels 42*a* and 44*a*. In this regard, contacts 192, 194 and 204 are easier to stamp and form than contacts 28 and 30**.

Second connector 258 (FIG. 14) is preferred from the molding viewpoint and contacts 210 for the optional feature mentioned above. Leads 216, 218, 220 and 222 are preferred because they do not need to be bent out of the plane of respective plates 214, 224 and 226.

Signal contacts 232 are slightly preferred over contacts 76 and 234.

In describing first connector 12 and second connector 14, contacts 28, 30, 72 and 74 were designated as either being power or ground. As is well known in the art, the actual use is determined by the back panel and circuit card design. The designations were for a preferred use; e.g., a longer blade 58 on a ground contact 30, but not for an only use.

Components structures deemed equivalent to those disclosed herein would include leads 52, 140, 158, 170, 216, 218, 220, 222, 238 and 256 adapted to be surface soldered to circuit pads (not shown) on back planes and circuit cards; twin beams contacts in lieu of cantilever beams 124 and 146; box receptacles for twin beam receptacles 168 and 236; and leads 52, etc. extending outwardly from a surface of dielectric housings 20, 70, 180 amd 198 not otherwise illustrated herein.

In the several connector embodiments illustrated and described herein, contacts 28, 30, 72 and 74; the modification thereto have been shown oriented transversely to the longitudinal axis of connectors 12 and 14; modifications thereto. However, it is intended to include, within the scope of the present invention, contacts 28, 30, 72 and 74, etc. being oriented parallel to the longitudinal axis; i.e., between adjacent rows of signal contacts 32 and 76 rather than between columns thereof as shown in the illustrations.

Another modification which is intended to be included within the scope of the present invention relates to plates 118 and 142 of respective contacts 72 and 74; modifications thereto. Plates 118 and 142, etc. are shown as being flat. However, these plates may advantageously be made to include vertical ribs or the like projecting perpendicularly outwardly from the plates and in between adjacent signal contacts 32 and 76 in the adjacent columns 38 and 90, etc.

Figure 16:
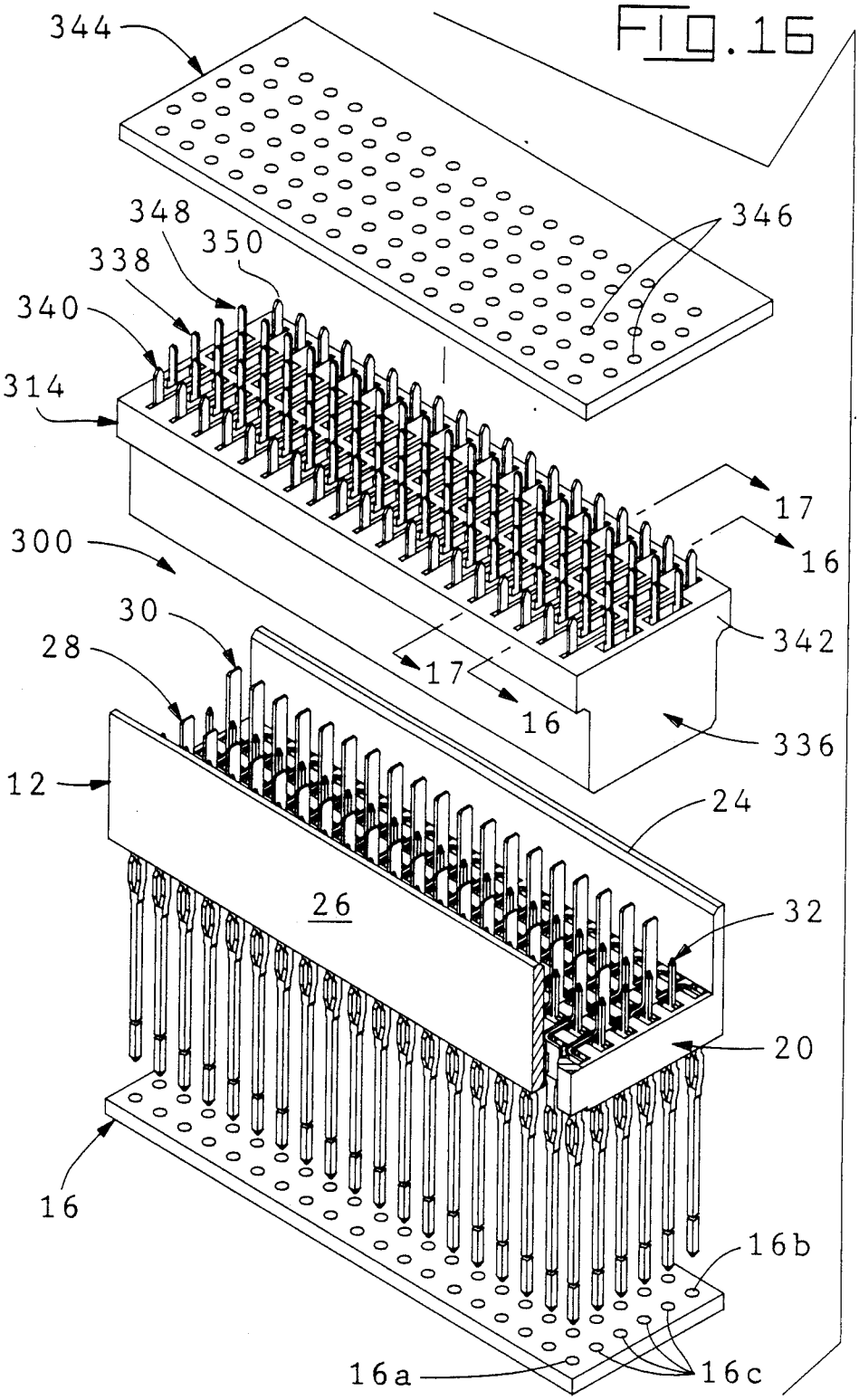
FIG. 16 is a perspective, exploded view of the electrical connector system constructed in accordance with the preferred embodiment of the present invention.

FIG. 16 shows electrical connector system 300 which includes first connector 12, described hereinabove, and second connector 314 which includes insulating housing 336, signal contacts 338 and ground contacts 340. As shown, housing 336 includes section 342 which fits into cavity 36 of connector 12. Shown above connector 314 is substrate 344 having plated through holes 346. Substrate 344 is mounted onto connector 314 with signal contact leads 348 and ground contact leads 350 being received in appropriate holes 346.

Figure 17:
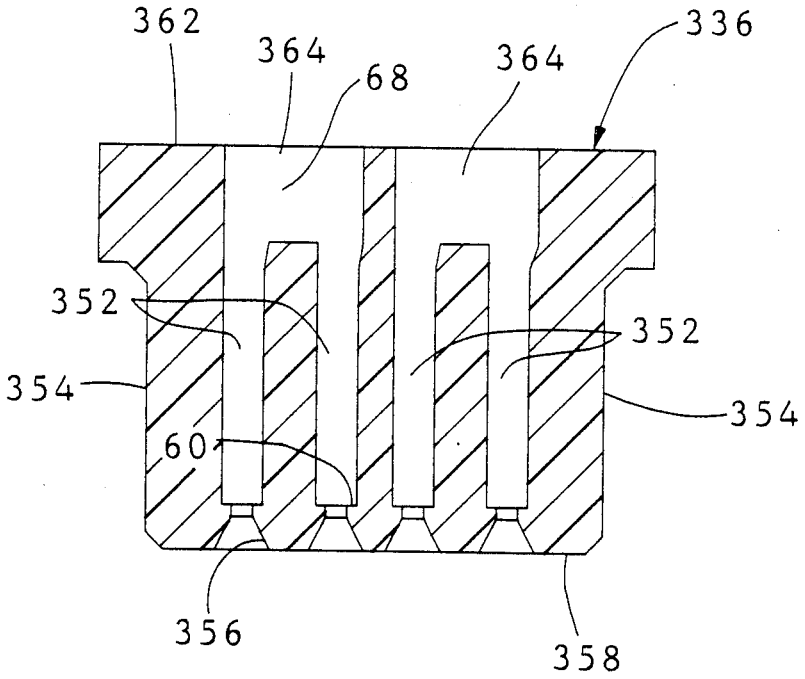
FIGS. 17 and 18 are cross-sectional views of contact receiving cavities in the receptacle connector taken along lines 17—17 and 18—18 of FIG. 16.

Passages 352 in housing 336 which receive signal contacts 338 are shown in FIG. 17. In the illustrated embodiment, a column comprises four passages 352 extending between sidewalls 354 of housing 336; i.e., a column is defined herein as extending across the width of housing 336 and a row is defined herein as extending longitudinally from end to end of housing 336. These definitions agree with industry usage.

Each passage 352 includes a funnel shaped opening 356 providing access thereinto on front surface 358 of housing 336. Further, passages 352 open out on rear surface 362 of housing 336 as indicated by reference numeral 364.

Figure 18:
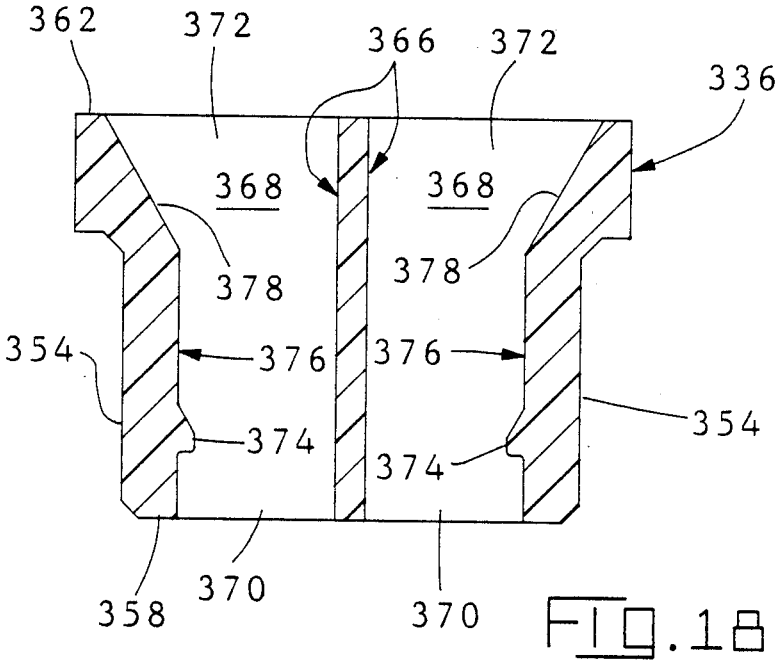

Slots 366 in housing 336 which receive ground contacts 340 are shown in FIG. 18. There are two slots 366 per column and they are isolated from adjacent columns of signal passages 352 by transverse walls 368. Each slot 366 opens out on front surface 358 and rear surface 362 as indicated by reference numerals 370 and 372 respectively. Inwardly projecting nose 374 is provided on outer walls 376 of slots 366. Further walls 376 slant outwardly towards sides 354 in the rearward direction as indicated by reference numeral 378.

As is well known in the industry, housings 322 and 336 are molded from a suitable plastics material such as high temperature thermoplastic.

Figure 19:
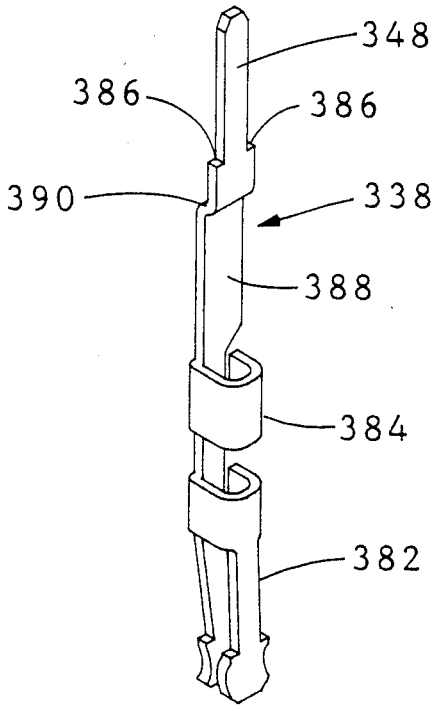
FIG. 19 is a perspective view of ground contacts.

As shown in FIG. 19, signal contact 338 includes a twin beam receptacle 382, retaining section 384, and aforementioned lead 348. Lead 348, which includes outwardly facing shoulders 386, is attached to and offset from connecting strap 388 with the offset being indicated by reference numeral 390.

Figure 20:
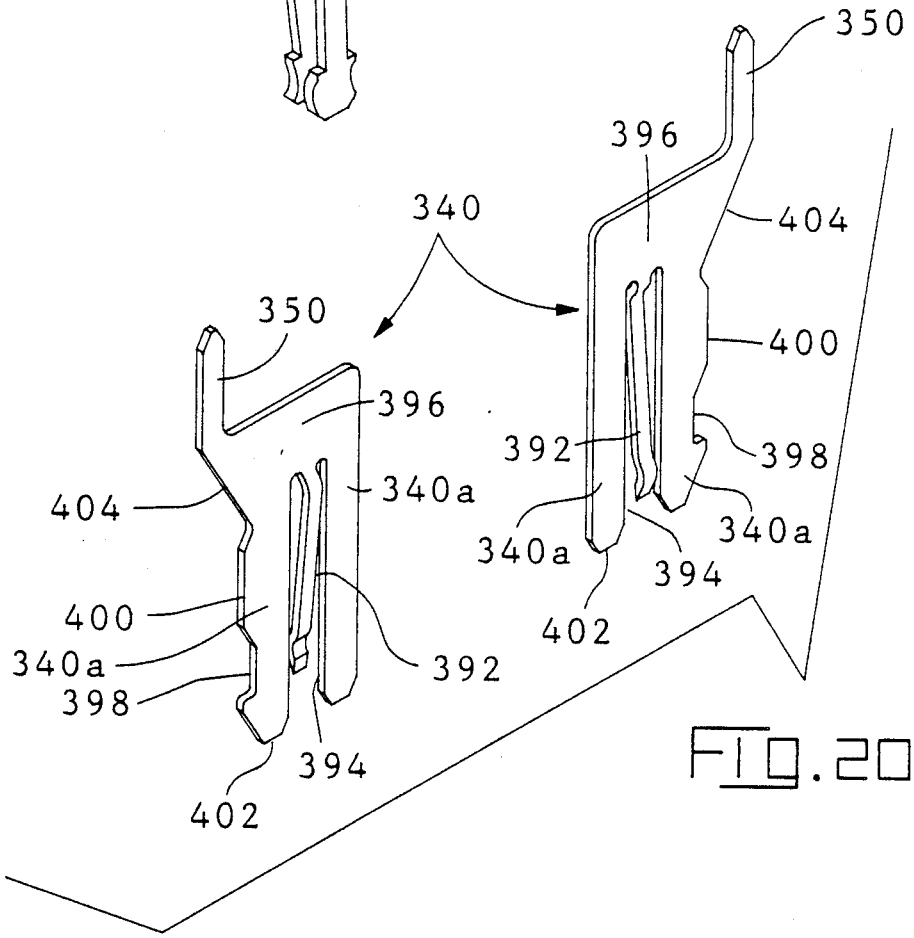
FIG. 20 is a perspective view of a signal receptacle contact.

Ground contacts 340, shown in FIG. 20, include a cantilever beam 392 extending forwardly in slot 394 cut into a relatively thin plate 396. Slot 394 defines resilient legs **340*a* on each side thereof. Notch 398 is provided in side 400 of plate 396 adjacent front end 402. Rearwardly side portion 404 of side 400 slants obliquely laterally, terminating in the aforementioned lead 350. The two contacts 340 shown in FIG. 20** are identical with one being turned around.

Figure 21:
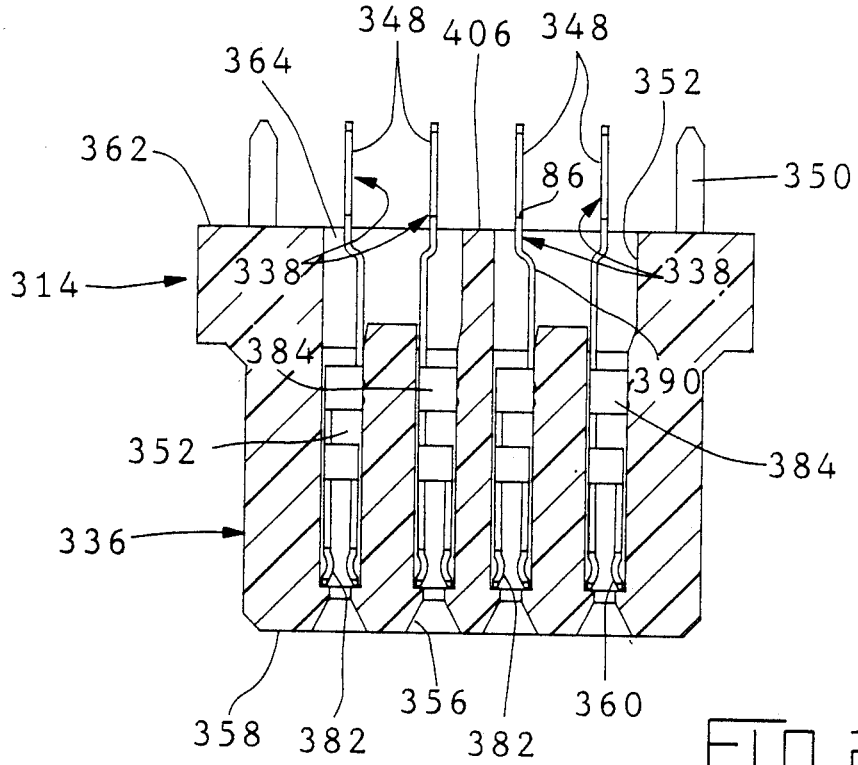
FIG. 21 is the cross-sectional view of FIG. 17 showing the ground contacts positioned in the appropriate cavities in the receptacle connector.
Figure 22:
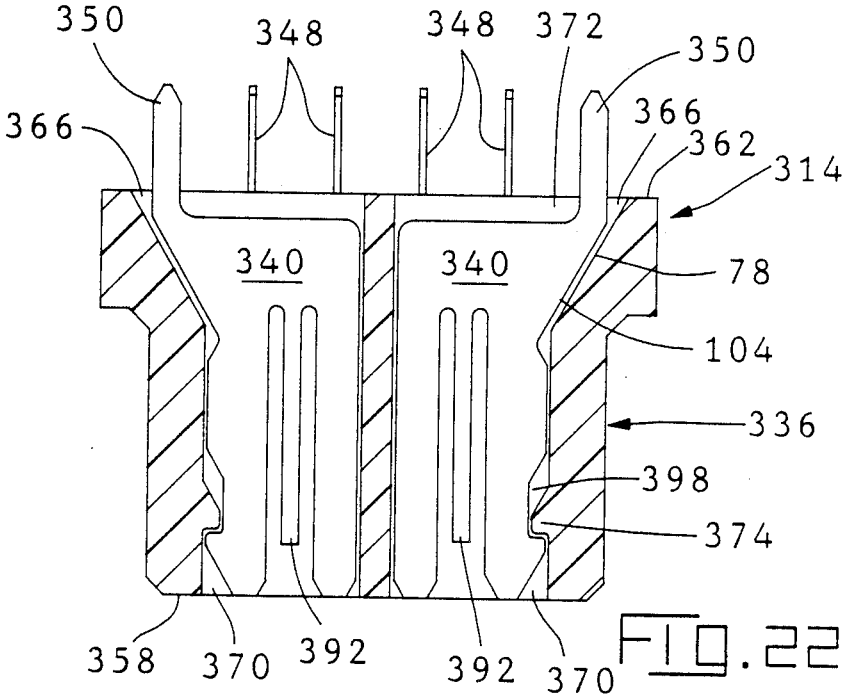
FIG. 22 is the cross-sectional view of FIG. 18 showing the signal receptacle contacts positioned in the appropriate cavities in the receptacle connector.

FIG. 21 shows signal contacts 338 positioned in passages 352 and FIG. 22 shows ground contacts 340 in slots 366 to form second connector 314. Retaining sections 384 frictionally holds contacts 338 in passages 352 with receptacles 382 open to openings 356. Leads 348 project rearwardly from rear opening 364. As shown, contacts 338 in the pairs of passages 352 on each side of median wall 406 of housing 336 are positioned therein in an opposite orientation. Leads 348 are on the same center line as receptacles 382 by reason of offsets 390. Contacts 338 are loaded into passages 352 from rear opening 364 with the free ends of receptacles 382 abutting or near shoulders 360.

Ground contacts 340 are retained in slots 366 against pull-out by reason of inwardly projecting noses 374 being received in notches 398. Slanted side portions 404 bear against slanted wall portion 378 of walls 376 to prevent forward movement of contacts 340. As is obvious, contacts 340 are loaded into slots 366 from rear openings 372 with legs **340*a* of plate 340 being resiliently cammed in to pass over noses 374 during insertion. Leads 350 extend outwardly from rear surface 362 on each side of the column of signal leads 348**.

Figure 23:
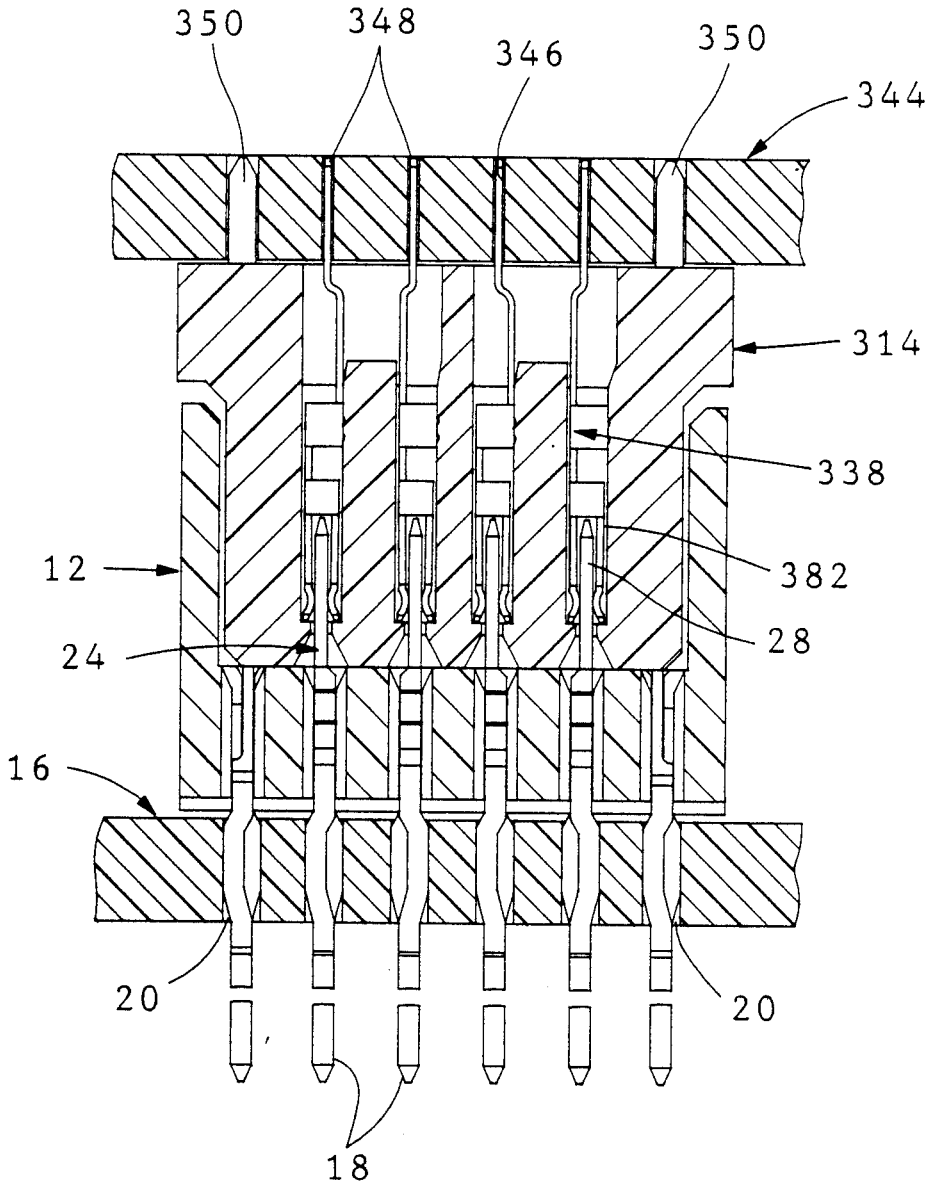
FIG. 23 is a cross-sectional view of the mated header and receptacle connectors showing the engaged signal contacts of both connectors.

FIG. 23 is a view showing connectors 12, 314 mounted on parallel substrates 16 and 344 respectively and mated together whereby signal circuits (not shown) on both substrates 16 and 344 are electrically interconnected by engaged signal contacts 32 and 338. As shown, posts 62 of contacts 32 in connector 12 are received in twin beam receptacles 382 of contacts 338 in connector 314.

Figure 24:
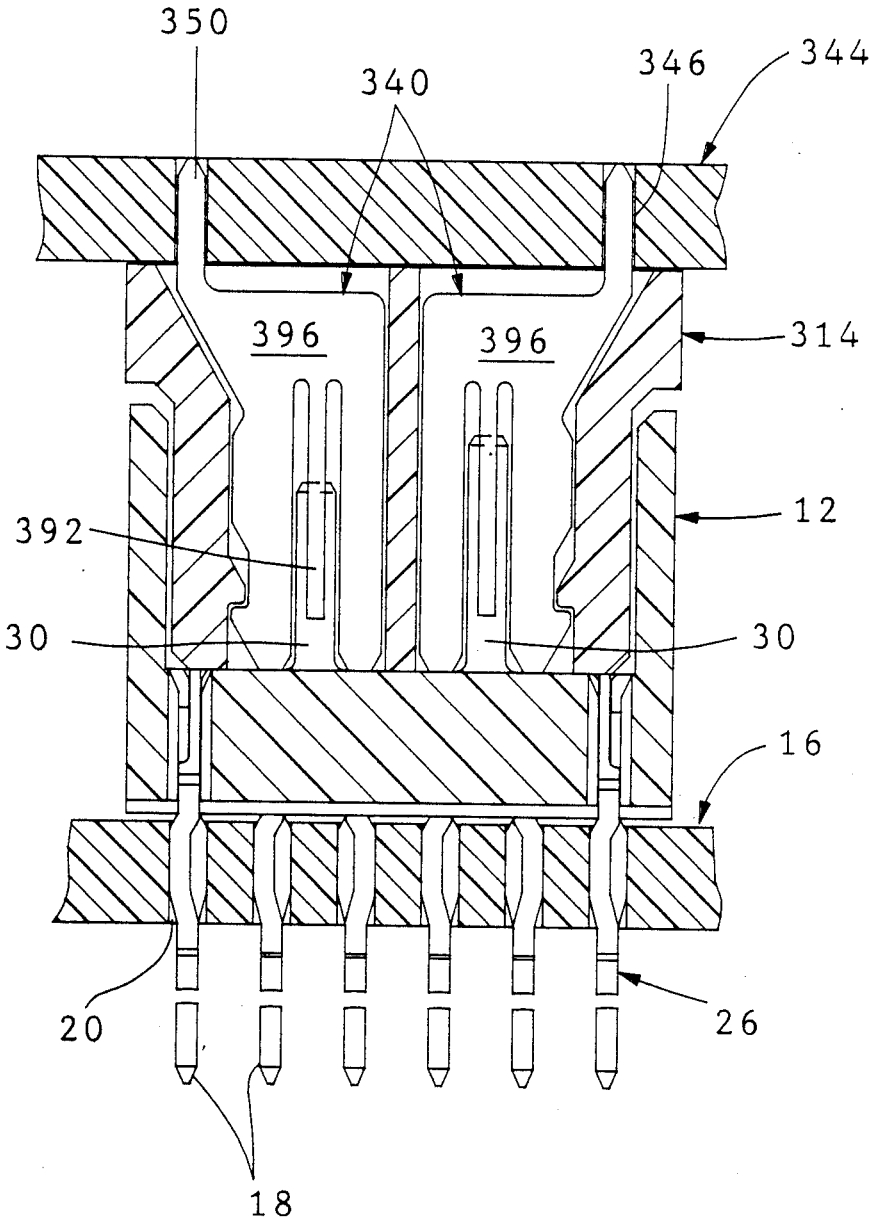
FIG. 24 is a cross-sectional view of the mated header and receptacle connectors showing the engaged ground contacts of both connectors.

FIG. 24 is a view similar to FIG. 23 but showing ground contacts 28, 30 and 340 engaged to interconnect ground circuits (not shown) on parallel substrates 16 and 344. Contact between contacts 28, 30 and 340 is made by cantilever beams 392 slidingly engaging blades 58.

Reference has been made above to contacts 340 being used as ground reference planes. However, if desired, one or more contacts 340 can be used to transmit power. In this event, blade 58 on a power contact 28 is made shorter than a blade 58 on a ground contact 30 so that the ground circuits are interconnected before the power circuits. As shown in FIG. 24 blade 58 on the left hand side is shorter relative to the blade 58 on the right hand side to illustrate this dual purpose of contacts 28,30.

Figure 25:
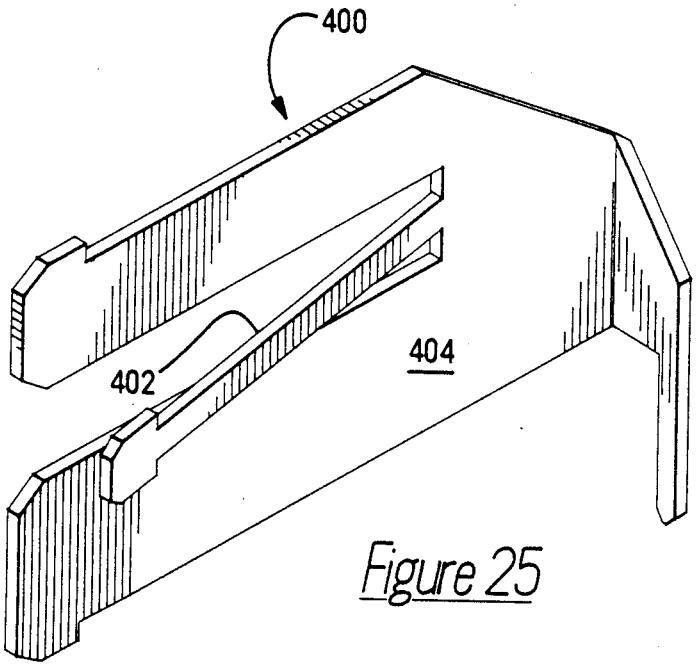
FIG. 25 is a perspective view of another embodiment of the present invention.

FIG. 25 shows another embodiment of the power or ground contact, indicated by reference number 400, which may be used in lieu of contacts 72 and 74. In this embodiment, cantilever beam 402 is bent out of the plane of plate 404 to such an extent that it engages a signal contact 32 in the adjacent row. Thus, a power or ground contact 28 and 30 would be omitted from connector 12 and the engaged signal contact 32 would be dedicated to ground or power as the case might be.

As can be discerned, a high density, high frequency connector system has been disclosed which provides enhanced signal integrity in high density connector systems comprising matable first and second connectors with the former mounted on a back plane and a circuit card mounted on the latter. Each connector includes a column and column configuration of contacts for carrying high frequency signals and alternating columns of contacts for providing a ground reference to maintain signal integrity. The ground contacts in one connector include blades extending outwardly. The ground contacts in the other connector includes blade-engaging cantilever beams in slots in plates of substantial width which cooperate to provide a blanket shield between adjacent columns of signal carrying contacts.

We claim:

1. An electrical connector system for use in electrically connecting circuits on a backplane and on a circuit card, said system comprising:

a first connector having columns of conductive signal contacts disposed in passages in a dielectric housing, said signal contacts having leads at one end extending outwardly from one surface of the housing for electrically engaging signal circuits on the backplane on which said first connector may be mounted and pins at another end extending into a cavity opening outwardly on another surface of said housing, and further having conductive other contacts disposed in other passages in said housing, said other contacts having leads at one end extending outwardly from said one surface for engaging other circuits on the backplane and blades at another end located between adjacent columns of said pins in said cavity; and a second connector having columns of conductive signal contacts disposed in passages in a dielectric housing, said signal contacts having leads at one end extending outwardly from one surface of the housing for electrically engaging signal circuits on the circuit card which may be attached to said second connector and receptacles at another end which are accessible through openings in another surface of said housing, and further having conductive other contacts disposed in slots in said housing with said slots being between adjacent columns of said signal contacts, said other contacts having leads extending outwardly from said one surface for electrically engaging other circuits on the circuit card and plates at another end, said plates carrying blade engaging means thereon which are accessible through slot openings on said another surface, said second connector adapted for being received in said cavity in said first connector with said pins and said receptacles being electrically engaged and said blade and said blade engaging means being electrically engaged.

2. The connector system of claim 1 wherein said other contacts in said first and second connectors provide a ground reference.

3. The connector system of claim 1 wherein some of said other contacts in said first and second connector provide a ground reference and others of said other contacts carry power.

4. The connector system of claim 1 wherein said blades on said other contacts are attached to and extend from strap means.

5. The connector system of claim 4 wherein there are a pair of blades between adjacent columns of pins and a pair of plates between adjacent columns of receptacles.

6. The connector system of claim 5 wherein said strap means attached to said pair of blades are severably joined.

7. The connector system of claim 5 wherein said pair of plates are severably joined.

8. The connector system of claim 5 wherein said strap means attached to said pair of blades are severably joined and said pair of plates are severably joined.

9. The connector system of claim 1 wherein said blade engaging means on said plates include a cantilever beam.

10. An improvement to an electrical connector system of the type having intermatable first and second connectors with both connectors having column and row configurations of electrically engaging signal contacts, said improvement comprising intermatable ground contacts wherein said ground contacts in said first connector include outwardly projecting blade means located between adjacent columns of said signal contacts and said ground contacts in said second connector each include a cantilever beam attached to plate means located between adjacent columns of said signal contacts in said second connector, each said beam adapted to slidingly engage a said blade means and each said plate means adapted to provide shielding between adjacent columns of said signal contacts when mated.

11. The improvement of claim 10 wherein there are a pair of said blade means between adjacent columns of said signal contacts in the first connector and a pair of said plate means between adjacent columns of said signal contacts in the second connector.

12. The improvement of claim 11 wherein said blade means are attached to and extend from strap means.

13. The improvement of claim 12 wherein said strap means on said pair of blade means are separably joined.

14. The improvement of claim 11 wherein said pair of plate means are separably joined.

15. The improvement of claim 10 wherein each said plate means include an ear on an edge thereof, said ear extending between adjacent said signal contacts in an adjacent column of said signal contacts.

16. An electrical connector system for use with parallel substrates, said system comprising:

a first connector for being mounted on one said substrate and having an outwardly open cavity at one surface, an opposing surface, and passages extending between said surfaces;

a plurality of first contacts disposed in some of said passages which are arranged in columns extending across the width of said connector, said first contacts having posts extending into said cavity;

a plurality of second contacts disposed in other of said passages and having blades thereon extending into said cavity between adjacent columns of said posts;

said first and second contacts further having leads extending outwardly from said opposing surface for electrically engaging circuits on the one substrate on which the connector may be mounted;

a second connector having a front surface, a rear surface, a plurality of second passages arranged in columns extending across the width of said connector and a plurality of slots located between adjacent columns of said second passages, said second passages and slots passing between said front and rear surfaces;

a plurality of third contacts disposed in said second passages and having receptacles positioned to electrically interconnect with respective ones of said posts of said first contacts when said first and second connectors are mated;

a plurality of fourth contacts disposed in said slots and having plate means for shielding said first and third contacts and for electrically engaging said blades when said first and second connectors are mated; and leads on said third and fourth contacts extending outwardly from said rear surface for electrically engaging circuits on another said substrate on which said second connector may be mounted parallel to said one substrate.

17. The connector system of claim 16 wherein said first and third contacts transmit signals and said second and fourth contacts provide a ground reference.

18. The connector system of claim 16, wherein said first and third contacts transmit signals, some of said second and fourth contacts provide a ground reference and other of said second and fourth contacts transmit power.

* * * * *